US006151006A

United States Patent [19]

Yanagi et al.

[11] Patent Number: 6,151,006

[45] Date of Patent: Nov. 21, 2000

[54] ACTIVE MATRIX TYPE DISPLAY DEVICE AND A METHOD FOR DRIVING THE SAME

[75] Inventors: Toshihiro Yanagi, Nara; Takafumi Kawaguchi, Yamatotakada; Makoto Takeda, Nara, all of Japan

[73] Assignee: Sharp Kabushiki Kaisha, Osaka, Japan

[21] Appl. No.: 08/506,211

[22] Filed: Jul. 24, 1995

[30] Foreign Application Priority Data

| | | | |
|---|---|---|---|
| Jul. 27, 1994 | [JP] | Japan | 6-175779 |
| Dec. 6, 1994 | [JP] | Japan | 6-302459 |
| Jul. 17, 1995 | [JP] | Japan | 7-180431 |

[51] Int. Cl.[7] ..... G09G 3/36

[52] U.S. Cl. ..... 345/94; 345/89; 345/147

[58] Field of Search ..... 345/94, 95, 96, 345/87, 89, 98, 99, 100, 147, 148, 213

[56] References Cited

U.S. PATENT DOCUMENTS

| | | | |
|---|---|---|---|
| 3,612,975 | 10/1971 | Keefe | 318/599 |
| 3,742,483 | 6/1973 | Ogle | 345/69 |
| 3,955,187 | 5/1976 | Bigelow | 340/324 M |
| 4,297,004 | 10/1981 | Nishimura et al. | 350/336 |
| 4,348,666 | 9/1982 | Ogita | 340/753 |
| 4,570,115 | 2/1986 | Misawa | 323/313 |
| 4,591,902 | 5/1986 | Masubuchi | 348/791 |
| 4,742,329 | 5/1988 | Yamada et al. | 340/347 |
| 4,745,403 | 5/1988 | Tamura | 340/713 |
| 4,752,774 | 6/1988 | Clerc et al. | 340/784 |
| 4,775,549 | 10/1988 | Ota et al. | 427/38 |
| 4,824,211 | 4/1989 | Murata | 350/332 |
| 4,834,510 | 5/1989 | Fujita | 340/805 |
| 4,870,398 | 9/1989 | Bos | 340/784 |
| 4,872,002 | 10/1989 | Stewart et al. | 340/811 |
| 4,908,613 | 3/1990 | Green | 340/719 |

(List continued on next page.)

FOREIGN PATENT DOCUMENTS

| | | |
|---|---|---|
| 0071911 | 2/1983 | European Pat. Off. . |
| 0221307 | 5/1987 | European Pat. Off. . |
| 0387550 | 9/1990 | European Pat. Off. . |
| 0391655 | 10/1990 | European Pat. Off. . |
| 0434465 A2 | 6/1991 | European Pat. Off. . |
| 0478371 | 4/1992 | European Pat. Off. . |
| 0478386 | 4/1992 | European Pat. Off. . |
| 0484159 | 5/1992 | European Pat. Off. . |
| 0488516 | 6/1992 | European Pat. Off. . |
| 0515191 A2 | 11/1992 | European Pat. Off. . |
| 0558060 A2 | 9/1993 | European Pat. Off. . |
| 0574891 A1 | 12/1993 | European Pat. Off. . |
| 0598308 A1 | 5/1994 | European Pat. Off. . |

(List continued on next page.)

OTHER PUBLICATIONS

Okada et al, "TFT–LCDs Using Newly Designed 6–bit Digital Data Drivers", SID 93 Digest, pp. 11–14, 1993.

Okada et al, "An 8–bit Digital Data Driver For AMLCDs", SID 94 Digest, pp. 347—350, 1994.

*IBM Technical Disclosure Bulletin*, vol. 33, No. 6B, Nov. 1990, "Driving Method for TFT/LCD Grayscale", pp. 384–385.

Everitt, W.L. "Communication Engineering", McGraw–Hill, 2nd Ed. New York, 1937, pp. 241–247.

Okada, "A Large, Full–Color TFT–LCD System for Multi–media Applications", ITE7 Technical Report, vol. 16, No.11, pp. 67–72 (Jan., 1992).

G.H. Henck Van Leeuven et al, "A Digital Column Driver 1C For AMLCDs", pp. 453–456 (AMLCD–P1 1993).

*Primary Examiner*—Dennis-Doon Chow

*Attorney, Agent, or Firm*—Nixon & Vanderhye P.C.

[57] ABSTRACT

An active matrix type display device according to the present invention includes: a display panel including a plurality of pixels arranged in a matrix shape, scanning lines connected to the plurality of pixels, and signal lines connected to the plurality of pixels; and a signal line driving circuit for receiving an analog video signal and driving each signal line with a signal line driving signal corresponding to a signal level of the analog video signal. The signal line driving circuit generates a pulse signal having a duty ratio corresponding to the signal level of the analog video signal and outputs the pulse signal.

11 Claims, 40 Drawing Sheets

U.S. PATENT DOCUMENTS

| | | | |
|---|---|---|---|
| 4,998,099 | 3/1991 | Ishii | 340/784 |
| 5,010,327 | 4/1991 | Wakita et al. | 340/784 |
| 5,066,945 | 11/1991 | Kanno et al. | 340/784 |
| 5,115,232 | 5/1992 | Iizuka | 340/784 |
| 5,162,786 | 11/1992 | Fukuda | 340/784 |
| 5,196,738 | 3/1993 | Takahara et al. | 307/296.1 |
| 5,214,417 | 5/1993 | Yamazaki | 340/784 |
| 5,266,936 | 11/1993 | Saitoh | 345/98 |
| 5,287,095 | 2/1994 | Kitazima et al. | 345/99 |
| 5,402,142 | 3/1995 | Okada et al. | 345/95 |
| 5,440,323 | 8/1995 | Okada | 345/100 |

FOREIGN PATENT DOCUMENTS

| | | |
|---|---|---|
| 0631394 A1 | 12/1994 | European Pat. Off. . |
| 89 01200 | 1/1989 | France . |
| 60-257683 | 12/1985 | Japan . |
| 1-182885 | 7/1989 | Japan . |
| 2-264294 | 10/1990 | Japan . |
| 3-89392 | 4/1991 | Japan . |
| 3-89393 | 4/1991 | Japan . |
| 3-177890 | 8/1991 | Japan . |
| 4-69169 | 4/1992 | Japan . |
| 4-329592 | 11/1992 | Japan . |
| 7-7248 | 1/1995 | Japan . |

*FIG. 22A* (D0, D1) = (0, 0)
(Prior Art)
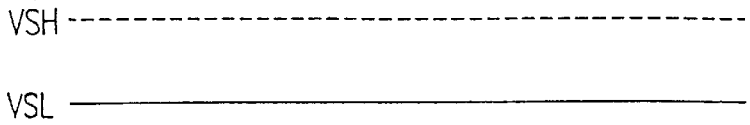
*FIG. 22B* (D0, D1) = (0, 1)
(Prior Art)
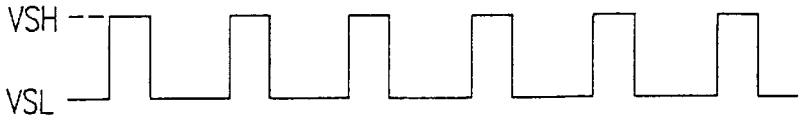
*FIG. 22C* (D0, D1) = (1, 0)
(Prior Art)
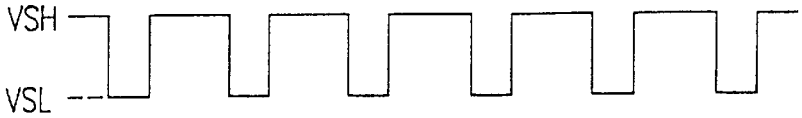
*FIG. 22D* (D0, D1) = (1, 1)
(Prior Art)
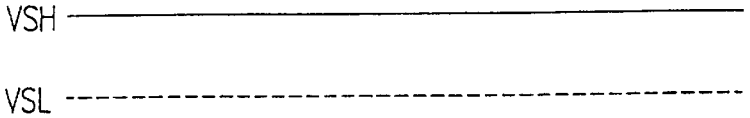

ACTIVE MATRIX TYPE DISPLAY DEVICE AND A METHOD FOR DRIVING THE SAME

BACKGROUND OF THE INVENTION

1. Field of the Invention

The present invention relates to an active matrix type display device and a method for driving the same. In particular, a duty ratio of a pulse for driving signal lines of the active matrix type display device is controlled based on an analog video signal according to the present invention.

2. Description of the Related Art

In recent years, high-resolution display devices which are suitable for high-vision television, personal computers, or work stations have been developed. Among these kinds of display devices, active matrix type liquid crystal display devices have such a structure that signal lines and scanning lines are formed within a liquid crystal panel in a matrix shape, with switching elements (such as thin film transistors) being provided at intersections thereof. In such a liquid crystal display device, the respective horizontal lines of switching elements are driven so as to be on and off in a sequential manner. As a result, a signal voltage is selectively provided for pixel electrodes, thereby exciting liquid crystal interposed between pixel electrodes and a counter electrode. By modulating light transmitted through the liquid crystal layer with the signal voltage, gray-scale display or full-color display can be attained.

The signal voltage is supplied by a signal line driving circuit connected to the signal lines within the display panel. The signal line driving circuit is generally classified into analog driver (hereinafter referred to as "AD") type signal line driving circuits and digital driver (hereinafter referred to as "DD") type signal line driving circuits. An AD signal line driving circuit receives analog video signals as input signals. A DD signal line driving circuit receives digital video signals as input signals.

In the present specification, a driving element including signal line driving circuits corresponding to individual signal lines may collectively be referred to as a "signal line driver" for conciseness.

FIGS. 15 and 16 are diagrams for describing conventional AD signal line driving circuits. FIG. 16 shows all the signal line driving circuits corresponding to a number N of signal lines. FIG. 15 shows a signal line driving circuit corresponding to an $i^{th}$ signal line (where i represents an integer). As shown in FIG. 15, the AD signal line driving circuit is controlled by a sampling capacitor Csmp, a hold capacitor CH, an analog signal SW1 which is controlled by a sampling pulse Tsmp(i), an analog signal SW2 which is controlled by an output pulse OE, and an output stage analog buffer 230. The sampling capacitor Csmp is designed so as to have a sufficiently large capacitance as compared with that of the hold capacitor CH.

The operation of the AD signal line driving circuit is described using a signal timing diagram shown in FIG. 17. An analog video signal Va input to the analog switch SW1 is sequentially sampled with sampling pulses Tsmp(1) to Tsmp(N), which correspond to the respective N pixels on one scanning line that is selected for every pulse of a horizontal synchronization signal Hsync. As a result of the sampling, momentary voltages Vsmp(1) to Vsmp(N) of the analog video signal Va which are taken at respective points of time, are applied to the respective sampling capacitors Csmp.

An $i^{th}$ sampling capacitor Csmp is charged by a voltage value Vsmp(i) of the analog video signal Va that corresponds to the $i^{th}$ pixel, and retains that value. The signal voltages Vsmp(1) to Vsmp(N), which have been sequentially sampled and thus retained, are transferred from the respective sampling capacitors Csmp to the corresponding hold capacitor CH in accordance with an output pulse OE, which is simultaneously supplied to all the analog switches SW2. Thus, the signal voltages Vsmp(1) to Vsmp(N) are output to the signal lines S(1) to S(N) connected to the respective pixels via the output stage analog buffers 230.

In the case of a liquid crystal display device employing the AD method, the light transmittance characteristics of the liquid crystal, i.e., the relationship between the voltage applied to the liquid crystal and the display luminance by the liquid crystal are not linear, as shown in FIG. 23. As a result, a luminance offset emerges when an analog video signal itself is input to the analog driver. Therefore, it is necessary to process the input analog video signal in such a manner as to correspond to the transmittance characteristics of the liquid crystal.

Moreover, in the case of a liquid crystal display device, liquid crystal material may deteriorate if a d.c. voltage is applied thereto, so that a signal processing circuit for achieving a.c. driving is required. FIG. 29 shows an exemplary circuit thereof. FIG. 30 shows a timing diagram for describing an exemplary operation of the circuit of FIG. 29. In FIG. 29, reference numerals OP10 and OP20 denote analog operation amplifiers; reference numerals SW10 and SW20 denote analog switches; INV10 denotes a logic inversion circuit (inverter). The analog video signal Va is coupled to a plus terminal of the operation amplifier OP10 and a minus terminal of the operation amplifier OP20. A variable d.c. voltage Vset for offset adjustment is coupled to a minus terminal of the operation amplifier OP10 and a plus terminal of the operation amplifier OP20. The outputs of the operation amplifier OP10 and OP20 are coupled to one terminal of the analog switch SW10 and SW20, respectively, whereas the other terminals of the analog switches SW10 and SW20 are connected to each other. Thus, the analog video signal Va is output as an a.c. analog video signal Va'. A polarity inversion signal POL controls the analog switch SW10 directly and controls the analog switch SW20 indirectly via the inverter INV10. As shown in FIG. 30, the analog video signal Va is a video signal commonly used for display by cathode ray tubes or the like. The polarity inversion signal POL is a signal which varies in synchronization with the horizontal synchronization signal Hsync. Accordingly, when the polarity inversion signal POL is at a high level, the analog switch SW10 is turned on so that the output of the operation amplifier OP10 is output, as shown in FIG. 30. When the polarity inversion signal POL is at a low level, the analog switch SW20 is turned on so that the output of the operation amplifier OP20 is output, as shown in FIG. 30. Thus, the a.c. analog video signal Va' is obtained. The a.c. analog video signal Va' is a signal whose polarity is inverted as shown in FIG. 30. By applying the a.c. analog video signal Va' to the conventional analog driver shown in FIGS. 15 and 16, a.c. driving is realized. In the present specification, the term "analog video signal" is defined to include both general analog video signals employed for display using CRTs (cathode ray tubes) and analog video signals which have been converted into a.c. signals.

FIGS. 18 and 19 are diagrams for describing conventional DD signal line driving circuits. FIG. 19 shows all the signal line driving circuits corresponding to a number N of signal lines (this corresponds to the AD signal line driving circuits shown in FIG. 16). FIG. 18 shows a signal line driving circuit corresponding to an $i^{th}$ signal line (where i represents an integer; this corresponds to the AD signal line driving circuit shown in FIG. 15). For conciseness, it is assumed that the input digital video signals are composed of 2 bits, namely, D0 and D1. That is, video data has four values of 0, 1, 2, and 3. The gray-scale voltage to be provided for each pixel is one of the four levels V0, V1, V2, and V3.

The signal line driving circuit shown in FIG. 18 includes the first D flip-flop (sampling flip-flop) Msmp, the second D flip-flop (hold flip-flop) MH, a decoder DEC, and analog switches ASW0 to ASW3 provided between the respective external gray-scale voltages V0 to V3 and the signal line S(i).

The operation of this signal line driving circuit is as follows. Video signal data D0 and D1 are taken into and retained in the sampling flip-flop Msmp, responsive to the rise of the sampling pulse Tsmp(i) corresponding to the $i^{th}$ pixel. An output pulse OE is supplied to the hold flip-flop MH when the sampling for one horizontal scanning period has finished, so that the video signal data D0 and D1 retained in the sampling flip-flop Msmp are taken into the hold flip-flop MH and output to the decoder DEC. The decoder DEC decodes the 2-bit video signal data D0 and D1, and places one of the analog switches ASW0 to ASW3 in a conductive state, so as to output the corresponding one of the external gray-scale voltages V0 to V3 to the signal line S(i).

Apart from the conventional DD method, a binary multiple gray-scale signal line driving circuit which realizes multiple gray-scale display by only inputting two voltage levels of high and low and a plurality of digital gray-scale oscillation signal, without requiring any external gray-scale voltages or internal analog switches is disclosed in Japanese Laid-Open Patent Publication No. 6-27900.

Prior to describing the operation principles of this binary multiple gray-scale signal line driving circuit, an active matrix type liquid crystal panel display device will be described.

FIG. 12 shows one display device of an active matrix type liquid crystal panel. FIG. 13 shows a schematic equivalent circuit thereof. In FIG. 13, the resistance component of a signal line is denoted as Rsource; the capacitance component thereof is denoted as Csource; the ON resistance of a switch element T (i,j) is denoted as RON; and the capacitance of the display device P(i,j) is denoted as CLC. In the case where a storage capacitance is provided in order to increase the voltage retention ratio of the pixel, the pixel capacitance CLC is a sum of the liquid crystal capacitance (liquid crystal cell) constituted by a liquid crystal layer interposed between a pixel electrode and a counter electrode plus the storage capacitance provided in parallel to the liquid crystal capacitance.

In general, RON is sufficiently larger than Rsource; Csource is sufficiently larger than CLC; and the time constant (RON×CLC) of the display device is sufficiently larger than the time constant (Rsource×Csource) of the signal line. In other words, the path from the output of a signal line driving circuit to a liquid crystal cell of an active matrix type liquid crystal display device has the characteristics of a low-pass filter. The characteristics are substantially determined by the time constant (RON×CLC) of the individual display device, rather than the time constant (Rsource×Csource) of the signal line itself.

The binary multiple gray-scale signal line driving circuit disclosed in Japanese Laid-Open Patent Publication No. 6-27900, supra, utilizes the above-described low-pass filter characteristics of each display device as a fundamental principal, so that the output of the signal line driving circuit has only two levels of high and low, namely, VSH and VSL. In other words, as shown in FIG. 14, the signal line driving circuit outputs a signal having a period of T, an amplitude of (VSH-VSL), and a duty ratio (i.e., VSH output time: VSL output time) of m:n. By setting the period T of the output of the signal line driving circuit at such a value that the output is sufficiently averaged by the above-mentioned low-pass filter, an average voltage of (m'VSH+n'VSL)/(m+n) is charged in the pixel. Accordingly, it is possible to charge the pixel with a desired voltage by adjusting the output duty ratio m:n of the signal line driving circuit.

FIG. 20 is a diagram for describing the constitution of the binary multiple gray-scale signal line driving circuit described in Japanese Laid-Open Patent Publication No. 6-27900. FIG. 20 shows a signal line driving circuit for providing four levels of voltage corresponding to two-bit data, the signal line driving circuit corresponding to the $i^{th}$ signal line (this corresponds to the conventional digital driver shown in FIG. 18). In FIG. 20, the operation based on a sampling flip-flop Msmp, a hold flip-flop MH, a sampling pulse Tsmp(i), and an output pulse OE, and the outputs Y0 to Y3 of a decoder DEC are the same as those of the circuit shown in FIG. 18. AND circuits 802 and 803, and a three-input OR circuit 804 are provided on the output side of the decoder DEC. Signals TM1 and TM2 (described later) are supplied to the other input of the AND circuits 802 and 803, respectively.

FIG. 21 shows the waveforms of the signal, TM1 and TM2. The duty ratio of the signal TM1 (i.e., the ratio between periods [m] in which the pulse is at "1" and periods [n] in which the pulse is at "0") is such the m:n=1:2. The duty ratio of the signal TM2 is such that m:n=2:1.

When video data (D0, D1)=(0, 0) is input to this binary multiple gray-scale signal line driving circuit, the output Y0 of the decoder DEC shifts to "1", and the other outputs Y1 to Y3 shift to "0". Since the inputs of the OR circuit 804 are all "0", the output of the OR circuit 804 is at VSL, as shown in FIG. 22A.

When video data (D0, D1)=(0, 1) is input, the output Y1 of the decoder DEC shafts to "1", and the other outputs Y0, Y2, and Y3 shift to "0". Accordingly, the output of the OR circuit 804 has a pulse waveform oscillating between VSH and VSL at the same duty ratio of m:n=1:2 of the signal TM1, as shown in FIG. 22B.

When video data (D0, D1)=(1, 0) is input, the output Y2 of the decoder DEC shafts to "1", and the other outputs Y0, Y1, and Y3 shift to "0". Accordingly, the output of the OR circuit 804 has a pulse waveform oscillating between VSH and VSL at the same duty ratio of m:n=2:1 of the signal TM2, as shown in FIG. 22C.

When video data (D0, D1)=(1, 1) is input to this binary multiple gray-scale signal line driving circuit, the output Y3 of the decoder DEC shifts to "1", and the other outputs Y0, Y1, and Y2 shift to "0". As a result, the output of the OR circuit 804 is at VSH, as shown in FIG. 22D.

Thus, when video data (D0, D1)=(0, 0) is input, the output voltage VSL of the signal line driving circuit itself is applied to the pixel. When video data (D0, D1)=(1, 1) is input, the output voltage VSH of the signal line driving circuit itself is applied to the pixel. When video data (D0, D1)=(0, 1) is input and when video data (D0, D1)=(1, 0) is input, the average voltage of the signal line driving circuit is supplied to the pixel as long as the frequencies of the signals TM1 and TM2, respectively, are set at a value sufficiently higher than the cut-off frequency of the low-pass filter characteristics of the path from the output of the signal line driving circuit to the pixel. Thus, the average voltage of (m'VSH+n'VSL)/(m+n) is charged in the pixel.

In a conventional AD method, the linear region of the output stage analog buffers 230 is generally as narrow as about 70% of the supply voltage, so that it requires a high resistance-voltage process for fabricating the circuitry elements so as to be capable of withstanding a high supply voltage, which results in an increase in the cost. If a large and high-resolution display panel is to be driven, a large load is imposed on the output stage analog buffer 230 provided for each signal line, thereby deteriorating the display quality.

In the case of an AD type liquid crystal display device, it is required to process the analog video signal itself so that the display-luminance characteristics of the display device, i.e., the relationship between the signal level of the analog video signal and the display luminance of the pixel due to the liquid crystal, becomes linear. This results in an increase in the cost.

Moreover, an AD type liquid crystal display device is required to be driven by an alternating current (a.c. driving). This requires a high-speed polarity inversion signal generation circuit capable of processing the band of analog video signals, which results in an increase in the cost.

Moreover, in certain types of display panels, the application of a positive voltage and a negative voltage having the same absolute value to a pixel electrode can result in a difference between the absolute values of respective retained voltage levels. In other words, merely inverting the polarity of a video signal may create a difference between the positive and negative voltage levels retained in the pixel. This causes flickering of images, and may develop an after-image phenomenon.

On the other hand, although a conventional DD method requires only four kinds of external gray-scale voltages of V0 to V3 in the case where the video signal data D0 and D1 are 2-bit data, full-color display is generally considered to require 8-bit information for each color of red, blue, and green as video signal data. When conducting full-color display by a conventional DD method, 256 external gray-scale voltages (V0 to V255) are required; so that 256 analog switches (ASW0 to ASW255) are required, each being provided between the corresponding one of the external gray-scale voltages V0 to V255 and the signal line. Thus, according to a conventional DD method, as many external gray-scale voltages, and analog switches for each signal line, are required as the number of gray-scale levels. Accordingly, the number of gray-scale voltages and the number of analog switches for each signal line increases as the number of gray-scale levels increases. This results in an increase in the chip size when the circuitry is made into an LSI, thereby increasing the cost.

The above-mentioned binary multiple gray-scale signal line driving circuit eliminates the need of the external gray-scale voltages and analog switches as required by a conventional DD method, and therefore realizes a low-cost signal line driving circuit. However, when this method is applied to full-color display, it is required to input 8-bit information for each color of red, blue, and green as video signal data, and substantially as many digital gray-scale oscillation signals (corresponding to TM1 to TM2 described above), having different duty ratios, as the number of gray-scale levels. It is very difficult to input such a large number of control signals to the signal line driving circuit. If a television image or the like, which is originally an analog signal, is to be displayed, a high-speed and high-resolution analog/digital conversion circuit is required, thereby increasing the cost.

Also in the above-mentioned binary multiple gray-scale signal line driving circuit, it may be necessary to drive signal lines having load capacitance with a pulse waveform so as to repeat charging and discharging, depending on the frequencies of the digital gray-scale oscillation signals (corresponding to the signals TM1 and TM2 above). This results in an increase in the power consumption.

In certain types of display panels, the oscillation voltage of the output of the signal line driving circuit is not sufficiently averaged by the low-pass filter characteristics of the path from the output of the signal line driving circuit to the pixel. This deteriorates the display quality.

SUMMARY OF THE INVENTION

An active matrix type display device according to the present invention includes: a display panel including a plurality of pixels arranged in a matrix shape, scanning lines connected to the plurality of pixels, and signal lines connected to the plurality of pixels; and a signal line driving circuit for receiving an analog video signal and driving each signal line in accordance with a signal line driving signal corresponding to a signal level of the analog video signal, wherein the signal line driving circuit generates a pulse signal having a duty ratio corresponding to the signal level of the analog video signal and outputs the pulse signal.

In on embodiment of the invention, the signal line driving circuit includes: a sample and hold circuit for sampling the analog video signal and generating a retained signal; a reference signal generation circuit for generating a reference signal; and a comparison circuit for comparing the retained signal with the reference signal and outputting a pulse signal having a duty ratio corresponding to the signal level of the analog video signal.

In another embodiment of the invention, the signal line driving circuit includes a digital buffer circuit connected to the signal line and having at least two output voltage levels, and drives the signal line with an output signal of the digital buffer circuit.

In still another embodiment of the invention, one of the two output voltage levels is a GND level.

In still another embodiment of the invention, the pulse signal is a binary pulse signal.

In still another embodiment of the invention, the signal line driving circuit outputs the pulse signal to the signal line, and circuitry from the signal line to the corresponding one of the pixels functions as a low-pass filter for the pulse signal.

A method for driving an active matrix type display device to which an analog video signal is input according to the present invention includes the steps of: generating a pulse signal having a duty ratio corresponding to a signal level of the analog video signal, and averaging the pulse signal and applying an average voltage to a pixel.

In still another embodiment of the invention, the signal line driving circuit controls the duty ratio of the pulse signal so that the relationship between the signal level of the analog video signal and display luminance of the pixels is kept linear.

In still another embodiment of the invention, the reference signal is a correction reference signal for correcting the non-linear relationship between the signal level of the analog video signal and display luminance of the pixels, and the comparison circuit compares the retained signal with the correction reference signal so as to generate a pulse signal corresponding to the signal level of the analog video signal and controls the duty ratio of the pulse signal so that the relationship between the signal level of the analog video signal and the display luminance of the pixels is kept linear.

In still another embodiment of the invention, the pulse signal is a binary pulse signal.

In still another embodiment of the invention, the signal line driving circuit outputs the pulse signal to the signal line, and circuitry from the signal line to the corresponding one of the pixels functions as a low-pass filter for the pulse signal.

In one embodiment of the invention, the step of generating the pulse signal includes a step of controlling the duty ratio of the pulse signal so that the relationship between the signal level of the analog video signal and display luminance of the pixels is kept linear.

In still another embodiment of the invention, the reference signal is a correction reference signal for correcting for a γ correction performed for the analog video signal, and the comparison circuit compares the retained signal with the correction reference signal so as to generate a pulse signal corresponding to the signal level of the analog video signal and controls the duty ratio of the pulse signal so as to correct for the γ correction performed for the analog video signal.

In still another embodiment of the invention, the signal line driving circuit further includes a comparison circuit for alternately inverting the duty ratio of the pulse signal in a periodic manner.

In still another embodiment of the invention, the signal line driving circuit further includes a logic operation circuit which receives an output of the comparison circuit and a polarity inversion signal and performs a logic operation so as to output a pulse signal obtained by logically alternately-inverting a signal having a duty ratio corresponding to the signal level of the analog video signal.

In still another embodiment of the invention, the pulse signal is a binary pulse signal.

In still another embodiment of the invention, the signal line driving circuit outputs the pulse signal to the signal line, and circuitry from the signal line to the corresponding one of the pixels functions as a low-pass filter for the pulse signal.

In another embodiment of the invention, the step of generating the pulse signal includes a step of inverting the duty ratio of the pulse signal and generating a pulse signal obtained by logically alternately-inverting a signal having a duty ratio corresponding to the signal level of the analog video signal.

In still another embodiment of the invention, the signal line driving circuit includes a comparison circuit for controlling the duty ratio of the pulse signal so as to correct for difference in voltage retention characteristics of the display panel between positive voltages and negative voltages.

In still another embodiment of the invention, the reference signal is a correction reference signal for correcting for differences in voltage retention characteristics of the display panel between positive voltages and negative voltages, and the comparison circuit compares the retained signal with the correction reference signal and outputs a result of the comparison to the logic operation circuit.

In still another embodiment of the invention, the pulse signal is a binary pulse signal.

In still another embodiment of the invention, the signal line driving circuit outputs the pulse signal to the signal line, and circuitry from the signal line to the corresponding one of the pixels functions as a low-pass filter for the pulse signal.

In still another embodiment of the invention, the step of generating the pulse signal includes a step of correcting for differences in voltage retention characteristics of a display panel.

In still another embodiment of the invention, the signal line driving circuit includes means for varying a cycle of the pulse signal.

In still another embodiment of the invention, the reference signal is a reference signal having a varying cycle.

In still another embodiment of the invention, the pulse signal is a binary pulse signal.

In still another embodiment of the invention, the signal line driving circuit outputs the pulse signal to the signal line, and circuitry from the signal line to the corresponding one of the pixels functions as a low-pass filter for the pulse signal.

In still another embodiment of the invention, the step of generating the pulse signal includes a step of varying a cycle of the pulse signal.

In still another embodiment of the invention, the signal line driving circuit further includes a comparison circuit for controlling output impedance with respect to the pulse signal.

In still another embodiment of the invention, an impedance element for controlling output impedance with respect to the pulse signal is provided between the comparison circuit and the signal line.

In still another embodiment of the invention, the pulse signal is a binary pulse signal.

In still another embodiment of the invention, the signal line driving circuit outputs the pulse signal to the signal line, and circuitry from the signal line to the corresponding one of the pixels functions as a low-pass filter for the pulse signal.

In still another embodiment of the invention, the step of generating the pulse signal includes a step of controlling output impedance of the pulse signal to be a desired value.

The signal line driving circuit of the active matrix type display device according to the present invention includes a means for generating a pulse signal (oscillation signal) having an appropriate duty ratio corresponding to the signal level of an input analog video signal. By allowing this pulse signal to pass through circuitry having the characteristics of a low-pass filter, the oscillation component of the pulse signal is suppressed, whereby an average voltage is obtained. By supplying the average voltage to a pixel as a data signal, it becomes possible to conduct display corresponding to the signal level of the input analog video signal. Accordingly, the present invention realizes a multitude of gray-scale voltages for gray-scale display with a simple construction, thereby making it possible to conduct multiple gray-scale display or full-color display.

An active matrix type display device according to one example of the present invention includes: a display panel having a plurality of pixels arranged in a matrix shape, signal lines connected to the pixels, and scanning lines connected to the pixels; and a driving circuit for driving the display panel. The driving circuit includes a signal line driving circuit, which includes a sample and hold circuit, a reference signal generation circuit, and a comparison circuit. The sample and hold circuit samples and retains a portion of an analog video signal corresponding to one row of pixels. The comparison circuit conducts a comparison operation for the level of a reference signal generated by the reference signal generation circuit and the level of the sampled/ retained analog video signal, so as to output a binary pulse signal having a duty ratio corresponding to the signal level of the analog video signal; that is, gray-scale signals corresponding to the levels of the analog video signal are generated by controlling the duty ratio of the binary pulse signal. Accordingly, the number of the external gray-scale voltages can be remarkably reduced. Since pulse signals having different duty ratios are generated by conducting a comparison between the analog video signal and the reference signal, there is no need to convert the analog video signal into a digital video signal. As a result, the circuit configuration can be simplified.

Since the circuitry existing in a signal path from the signal line to the pixel (which are included in the display panel) has low-pass filter characteristics, an average voltage of the pulse signal can be applied to the pixel even by directly outputting a pulse signal containing an oscillation component to the signal line. Therefore, by utilizing the low-pass filter characteristics of the circuitry existing in a signal path from the signal line to the pixel (which are included in the display panel), the construction of the device can be simplified and the power consumption reduced.

By designing the signal line driving circuit so as to include a digital buffer circuit having at least two output voltage levels coupled to the signal line, the output signal of the digital buffer circuit driving the signal line, and prescribing one of the output voltage levels to be a GND level, it becomes possible to drive a multiple gray-scale signal line driving system with a single power supply.

A signal line driving circuit according to another example of the present invention, when converting an analog video signal into a pulse signal having a duty ratio corresponding to the signal level thereof, corrects the duty ratio of the pulse signal in such a manner that the relation between the level of the analog video signal and the display luminance of the pixel (i.e., the display luminance characteristics) becomes linear, and outputs the corrected pulse signal as a signal line driving signal to the signal line. Thus, the signal line driving circuit avoids luminance offset due to non-linear relation. The correction of the duty ratio can be achieved by correcting the waveform of the reference signal to be compared with the analog video signal. Since it is not necessary to employ a high-speed analog correction circuit for performing correction for the analog video signal in view of the non-linear relation between the voltage applied to the liquid crystal and the luminance level, the cost and the power consumption can be reduced, while increasing the integration degree of the device.

A signal line driving circuit according to still another example of the present invention includes a correction reference signal generation circuit for generating a correction reference signal for correcting for the $\gamma$ correction to which an analog video signal is subjected. The comparison circuit generates a pulse signal having a duty ratio corresponding to the signal level of the analog video signal and to the gray-scale luminance characteristics for which the effect of the $\gamma$ correction has been removed, by conducting a comparison operation between the sampled values of the analog video signal and the correction reference signal. Therefore, even when an analog video signal for display by a cathode ray tube is used as an input signal for an active matrix type liquid crystal display device, the $\gamma$ correction intended for display by a cathode ray tube, which has been performed for the analog video signal at the transmission side, exercises no effect. As a result, the liquid crystal display device can provide optimum image quality.

A signal line driving circuit according to still another example of the present invention, when converting an analog video signal into a pulse signal having a duty ratio corresponding to the signal level of the analog video signal so as to be output to the signal line, employs a simple logic operation circuit to periodically invert the duty ratio of the pulse signal for an output. Therefore, it is possible to achieve a.c. driving without using a high-speed analog polarity inversion signal generation circuit capable of processing the band of analog video signals. As a result, the cost and the power consumption can be reduced, while increasing the integration degree of the device.

A signal line driving circuit according to still another example of the present invention, when converting an analog video signal into a pulse signal having a duty ratio corresponding to the signal level of the analog video signal so as to be output to the signal line, achieves a.c. driving by employing a simple logic operation circuit to periodically invert the duty ratio of the pulse signal for an output, and also applies a voltage such that the voltage retention characteristics, which vary depending on the polarity (of plus or minus) of a voltage applied to the display panel, are corrected. As a result, optimum image quality can be provided, free from flickering or after-images due to the difference in the voltage retention characteristics between plus and minus voltages applied to the display panel.

A signal line driving circuit according to still another example of the present invention, when converting an analog video signal into a pulse signal having a duty ratio corresponding to the signal level of the analog video signal so as to be output to the signal line, can vary the frequency of the pulse signal to be output to the signal line having load capacitance to be a desired value. As a result, the power consumption of the device can be reduced.

A signal line driving circuit according to still another example of the present invention, when converting an analog video signal into a pulse signal having a duty ratio corresponding to the signal level of the analog video signal so as to be output to the signal line, can vary the output impedance of the signal line driving circuit. As a result, optimum image quality can be provided even by a display panel for which the low-pass filter characteristics of the path from the output of the signal line driving circuit to the pixel do not sufficiently average out the pulse signal, allowing the display quality to deteriorate.

Thus, the invention described herein makes possible the advantage of providing (1) an active matrix type display device capable of multiple gray-scale display or full-color display by employing a simple construction, and (2) a method for driving the same.

These and other advantages of the present invention will become apparent to those skilled in the art upon reading and understanding the following detailed description with reference to the accompanying figures.

BRIEF DESCRIPTION OF THE DRAWINGS

FIG. 22A to 22D are diagrams showing output waveforms of a conventional binary multiple gray-scale signal line driving circuit.

DESCRIPTION OF THE PREFERRED EMBODIMENTS

Hereinafter, the present invention will be described by way of examples, with reference to the accompanying figures.

An active matrix type display device in accordance with the present invention generates a plurality of gray-scale signals by averaging binary pulse signals having duty ratios corresponding to the levels of an analog video signal. A signal line driving circuit of the active matrix type display device of the present invention converts an input analog video signal into a pulse signal having an appropriate duty ratio of m:n corresponding to the level of the input analog video signal. By allowing the pulse signal to pass through circuitry having the characteristics of a low-pass filter, an average voltage is obtained; the oscillation component of the pulse signal is suppressed in the average voltage. By applying the average voltage having a voltage corresponding to the level of the analog video signal to a pixel, multiple gray-scale display or full color display can be achieved. The circuitry extending from a signal line to the pixel can be utilized as the circuitry having the low-pass filter characteristics to average the pulse signal.

Figure 14:
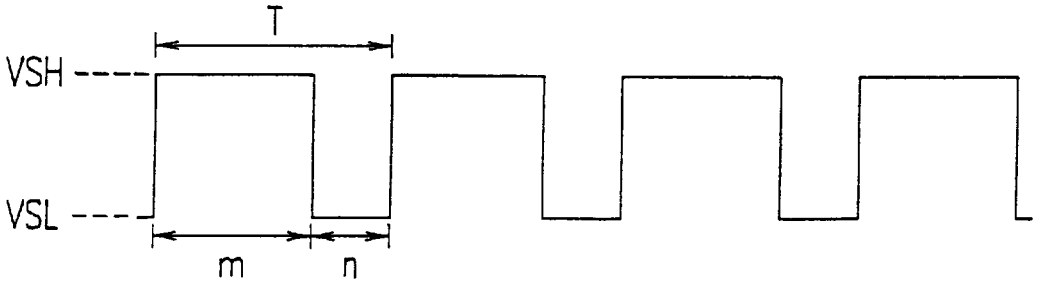
FIG. 14 (Prior Art)
FIG. 14 is a waveform diagram showing an output waveform obtained by a signal line driving circuit of a conventional active matrix type display device.
Figure 15:
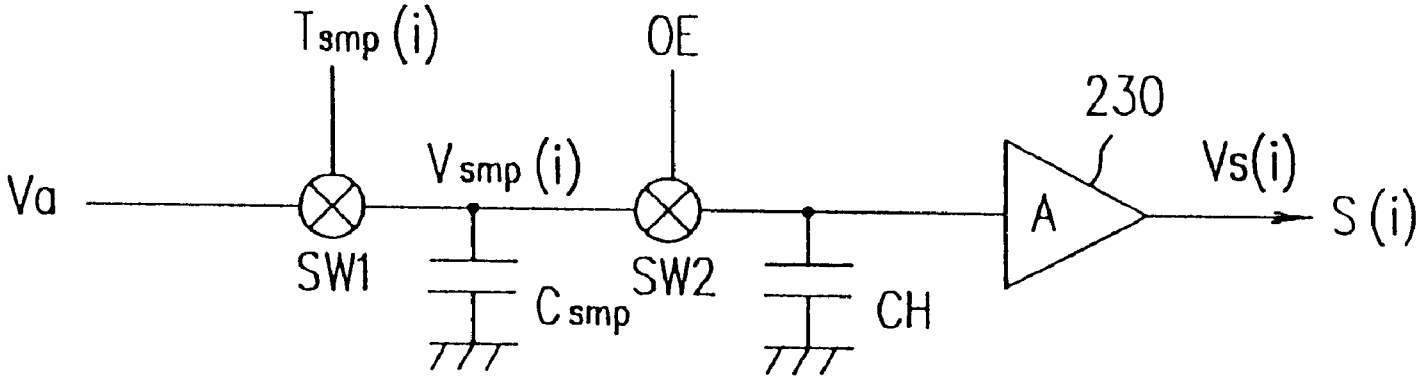
FIG. 15 (Prior Art)
FIG. 15 is a diagram showing the configuration of a portion of an analog driver corresponding to an $i^{th}$ signal line (where i represents an integer).
Figure 16:
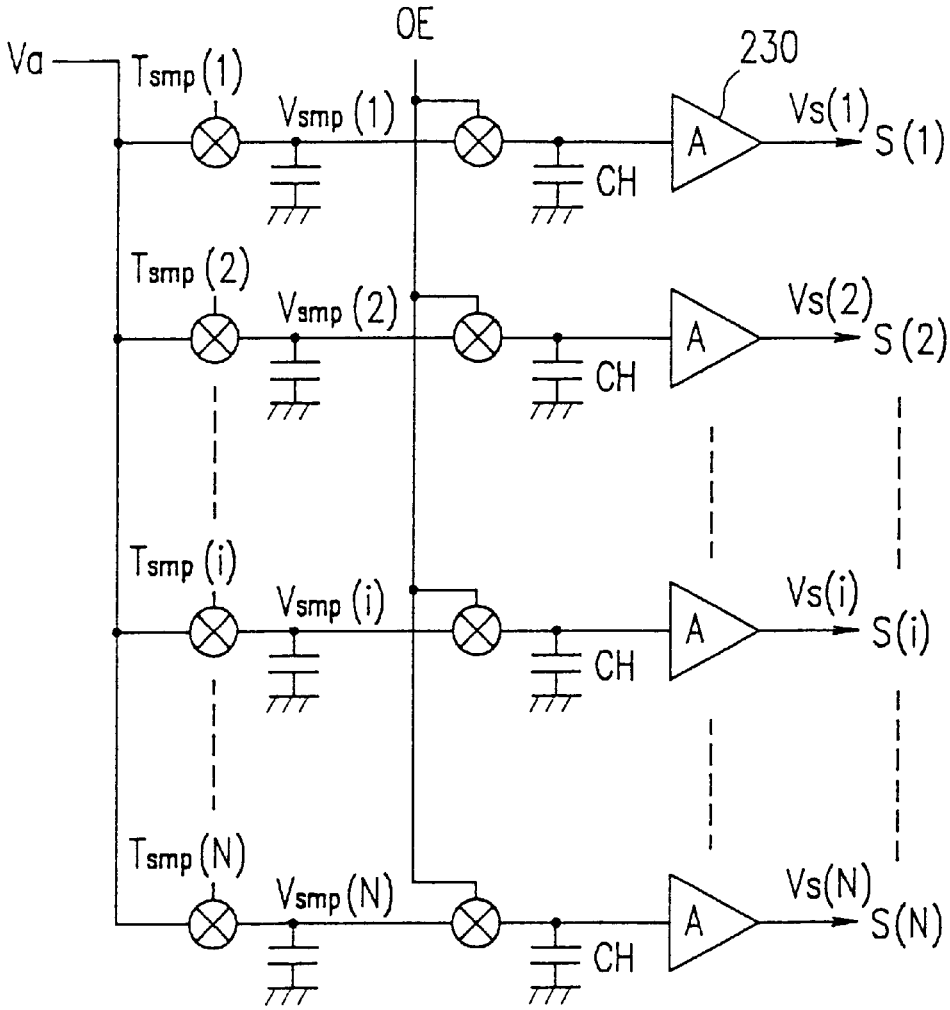
FIG. 16 (Prior Art)
FIG. 16 is a diagram showing the configuration of the entire analog driver shown in FIG. 15.
Figure 17:
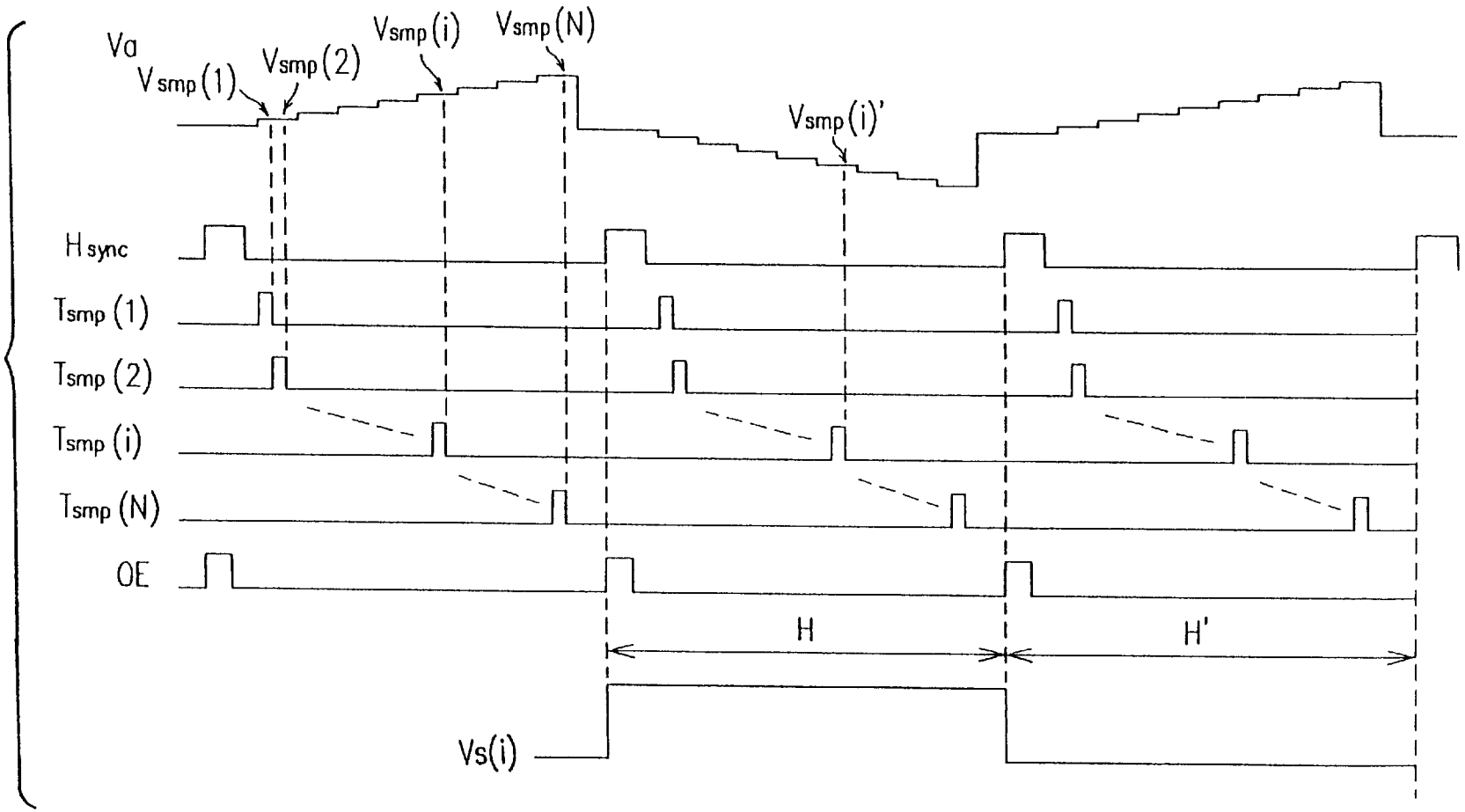
FIG. 17 (Prior Art)
FIG. 17 is a waveform diagram showing a waveform obtained by an analog driver method.
Figure 18:
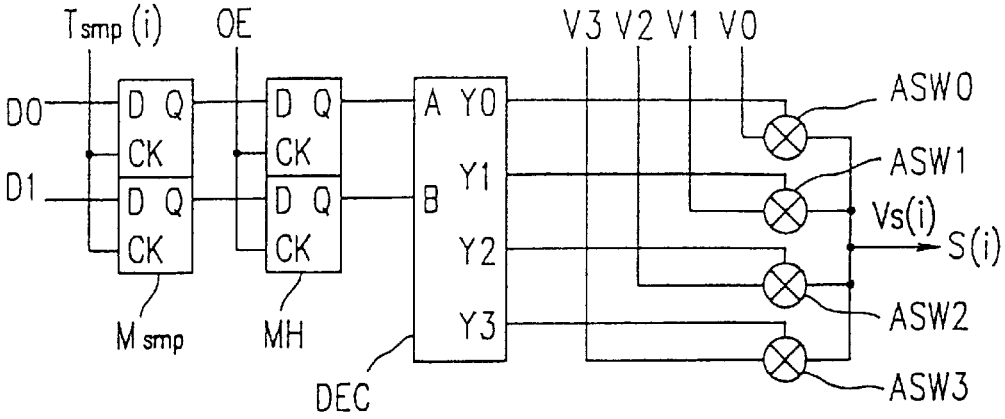
FIG.18 (Prior Art)
FIG. 18 is a diagram showing the configuration of a portion of a digital driver corresponding to an $i^{th}$ signal line (where i represents an integer).
Figure 19:
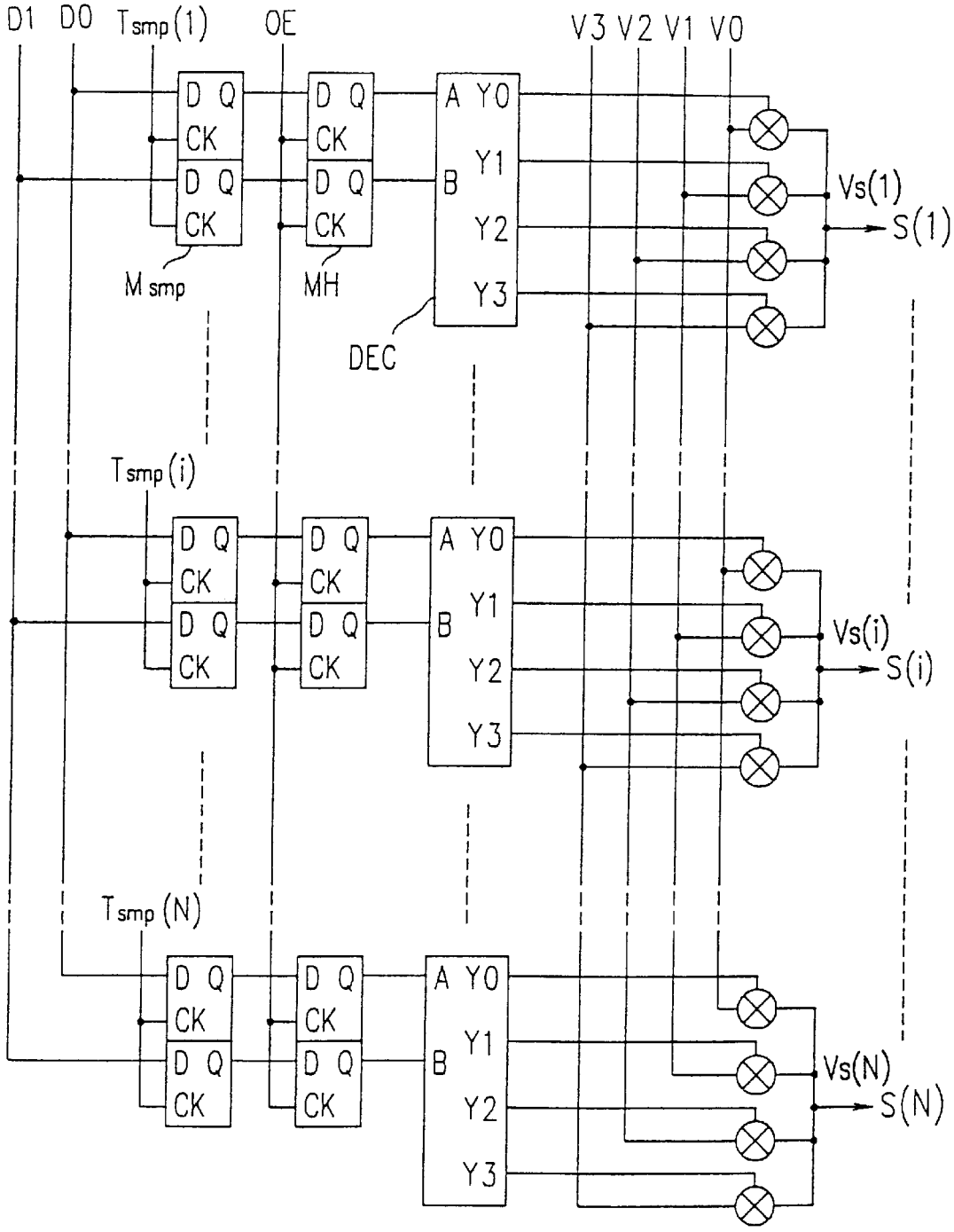
FIG. 19 (Prior Art)
FIG. 19 is a diagram showing the configuration of the entire digital driver shown in FIG. 18.
Figure 20:
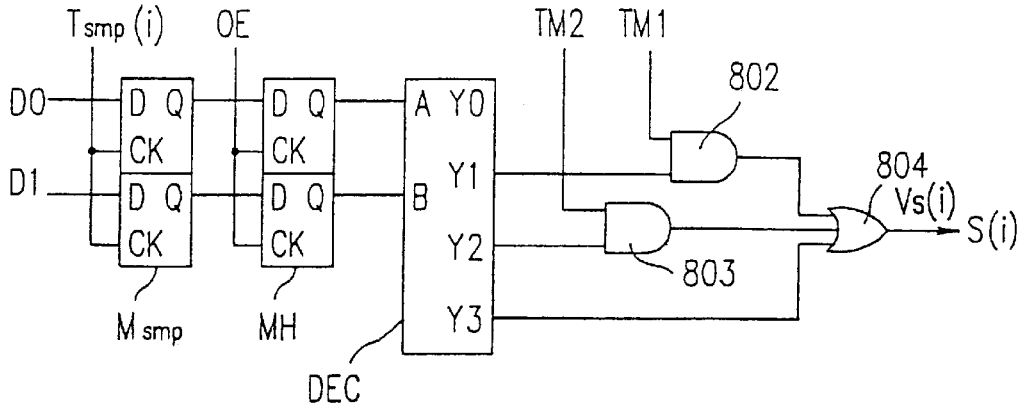
FIG. 20 (Prior Art)
FIG. 20 is a diagram showing the configuration of a binary multiple gray-scale signal line driving circuit corresponding to an $i^{th}$ signal line (where i represents an integer).
Figure 21:
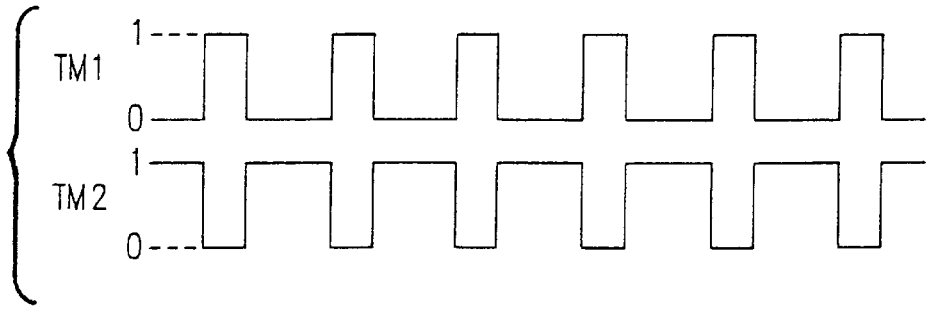
FIG. 21 (Prior Art)
FIG. 21 is a diagram showing a waveform of a digital gray-scale oscillation signal in the case of a conventional binary multiple gray-scale signal line driving circuit.

As in the case of the above-mentioned binary multiple gray-scale signal line driving circuit, the output of the signal line driving circuit of the present invention has only two voltage levels of high and low, namely, VSH and VSL. Accordingly, as in the signal waveform shown in FIG. 14, the signal line driving circuit of the present invention outputs a pulse signal having a period of T, an amplitude of (VSH−VSL), and a duty ratio (i.e., VSH output time:VSL output time) of m:n. By setting the period T at such a value that the level thereof is sufficiently averaged by the above-mentioned low-pass filter, an average voltage of (m·VSH+n·VSL)/(m+n) is charged in the pixel.

EXAMPLE 1

Figure 1:
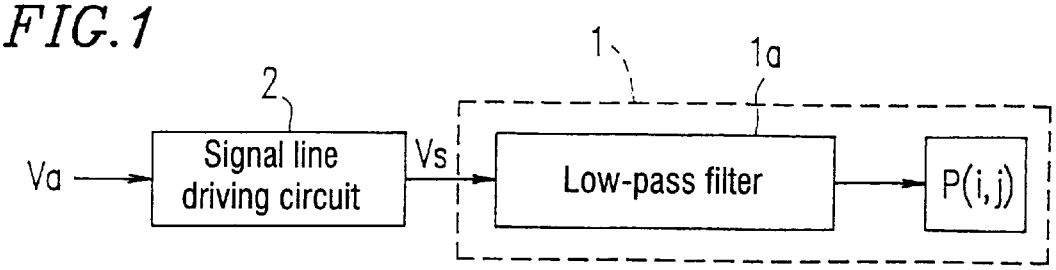
FIG. 1 is a diagram showing the fundamental configuration of an active matrix type display device according to Example 1 of the present invention corresponding to one signal line.

FIG. 1 is a schematic diagram showing an operation of a signal line driving circuit 2 of an active matrix type display device according to Example 1 of the present invention. The signal line driving circuit 2 of the present example receives an analog video signal Va and converts the analog video signal Va into a pulse signal Vs having a duty ratio corresponding to the level the analog video signal, and then outputs the pulse signal Vs to a signal line. The circuitry extending from the signal line to a pixel P(i,j), which are formed in a display panel 1, acts as a low-pass filter 1*a*. As a result, an average voltage in which the oscillation component of the pulse signal Vs is suppressed is applied to the pixel P(i,j). Although the pixel P(i,j) is shown to be separate from the low-pass filter 1*a* in FIG. 1 for conciseness, the pixel P(i,j) also functions as a part of the low-pass filter 1*a*. Although the circuitry extending from the signal line to the pixel P(i,j) formed in the display panel 1 is utilized as the low-pass filter for averaging the pulse signal Vs in the present example, it is also applicable to provide a low-pass filter outside the display panel.

Figure 9:
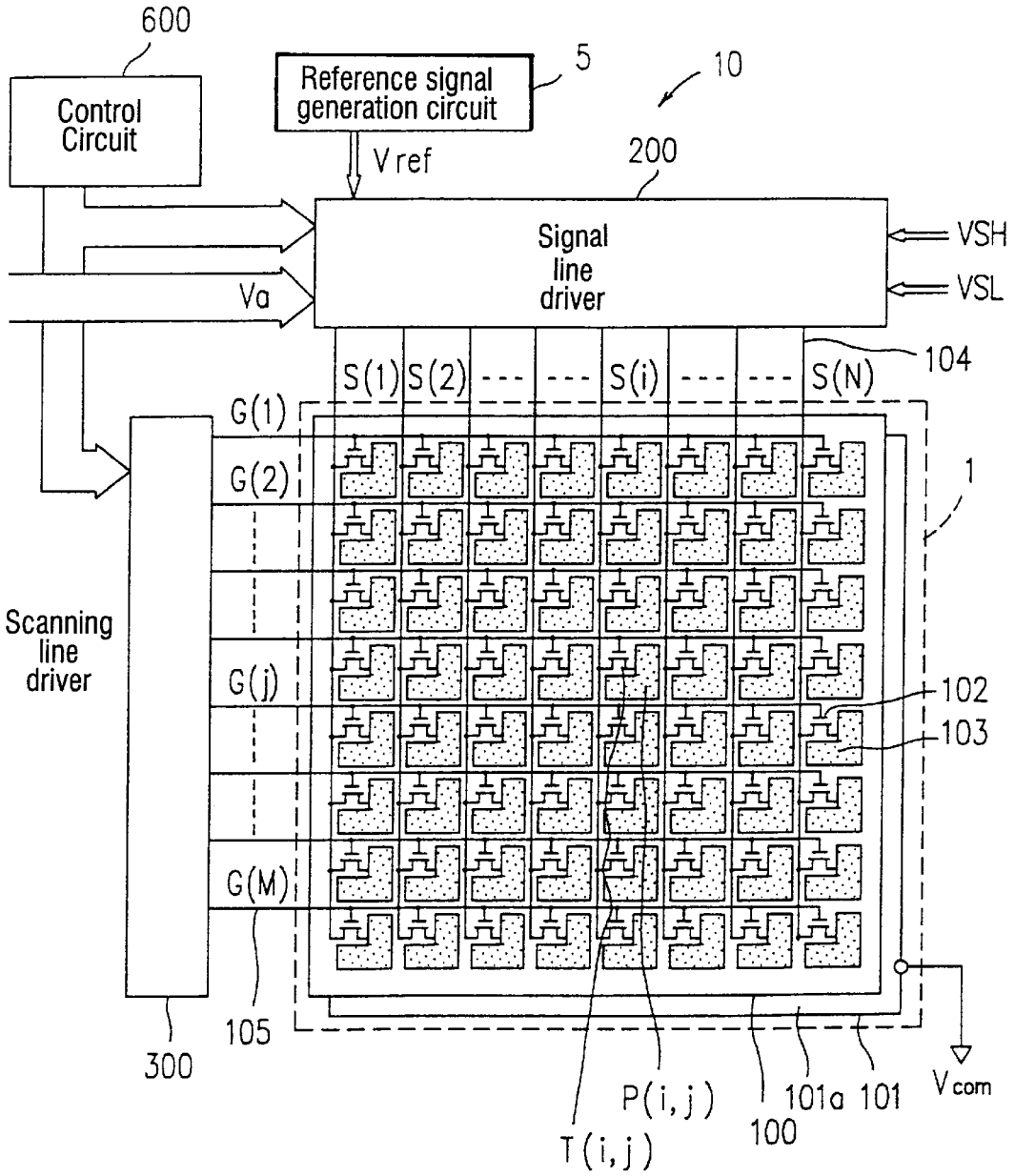
FIG. 9 is a diagram showing the overall configuration of an active matrix type display device according to Example 1.

FIG. 9 shows the entire configuration of a liquid crystal display device 10 of the present example. As shown in FIG. 9, the active matrix type liquid crystal display device 10 includes the display panel 1, a signal line driver 200, a scanning line driver 300, a control circuit 600, and a reference signal generation circuit 5.

On an active matrix substrate 100 included in the display panel 1, signal lines 104 and scanning lines 105 are formed in a matrix shape. Pixel electrodes 103 and switching elements 102 such as thin film transistors are formed in the intersections of the signal lines 104 and scanning lines 105. The signal line driver 200 generates signal line driving signals based on a signal from the reference signal generation circuit 5 and the analog video signal Va. The scanning line driver 300 drives the switching elements 102 so as to be on or off. The operations of the signal line driver 200 and the scanning line driver 300 are controlled by the control circuit 600.

In accordance with the display device 10, the respective horizontal lines of switching elements the switching elements 102 are driven so as to be sequentially on or off by the scanning line driver 300. If a signal voltage from the signal line driver 200 is selectively supplied to one of the pixel electrodes 103, a liquid crystal layer interposed between the pixel electrode 103 and a counter electrode 101*a* formed on a counter substrate 101 is driven. As a result, light passing through the liquid crystal layer is modified by the signal voltage, whereby an image is displayed. The pixel electrode 103, the counter electrode 101*a*, and the liquid crystal layer interposed therebetween constitute a pixel P(i,j). In the case where a storage capacitance is formed in parallel to the liquid crystal capacitance created by the pixel electrode 103, the counter electrode 101*a*, and the liquid crystal layer therebetween with a view to improving the voltage retention characteristics, the capacitance of the pixel equals the sum of the liquid crystal capacitance and the storage capacitance.

In the display panel 1, a low-pass filter is constituted by the time constants Rsource×Csource of the signal lines 104 themselves, the time constants of the individual pixels, and the like.

Next, the configuration and operation of the signal line driving circuit 2 (shown in FIG. 1) corresponding to one signal line 104, included in the signal line driver 200 above, will be described with reference to FIGS. 1 to 4.

The signal line driving circuit 2 shown in FIG. 1 receives an analog video signal Va and outputs a binary pulse signal Vs. The output Vs of the signal line driving circuit 2 is input to one of the signal lines 104 of the display panel 1, and reaches the pixel P(i,j) via the low-pass filter 1*a* constituted by the display panel 1.

Figure 2:
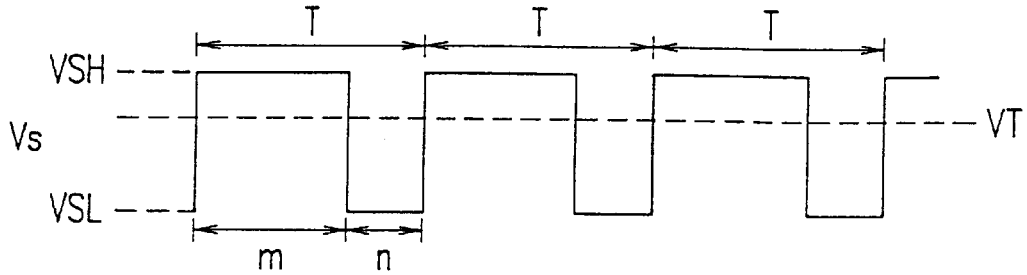
FIG. 2 is a waveform diagram showing an exemplary output waveform of the signal line driving circuit shown in FIG. 1.

FIG. 2 shows an exemplary output waveform of the output Vs of the signal line driving circuit 2. The output signal Vs of the signal line driving circuit 2 has two levels of high and low (i.e., VSH and VSL, respectively), a period of T, and a duty ratio (i.e., VSH output time:VSL output time) of m:n.

Figure 3:
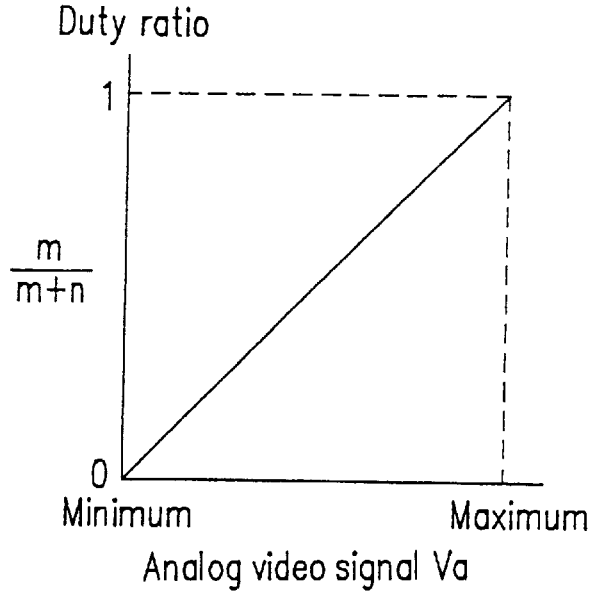
FIG. 3 is a diagram showing the relationship between an analog video signal and duty ratios.
Figure 4:
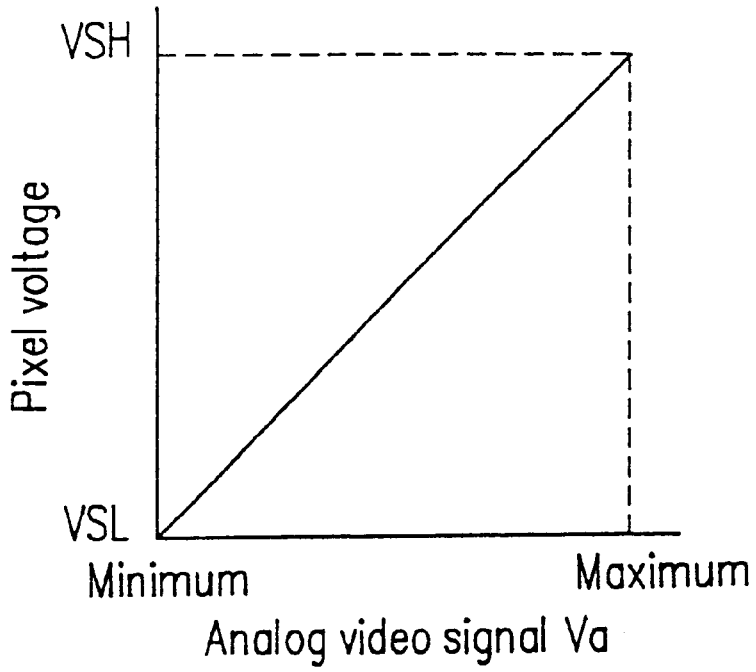
FIG. 4 is a diagram showing the relationship between an analog video signal and pixel voltages.

The signal line driving circuit 2 is so configurated as to vary the duty ratio of the output Vs thereof based on the analog video signal Va, as shown in FIG. 3. Since the period T of the output Vs is prescribed in view of the low-pass filter characteristics of the display panel 1, an average voltage VT of (m·VSH+n·VSL)/(m+n) is charged in the pixel P(i,j) where m and n are positive real numbers not limite to integers. Accordingly, it is possible to charge the pixel with a desired voltage based on the analog video signal Va. As a result, multiple gray-scale display or full-color display can be attained.

Hereinafter, the specific configuration and the operation of the signal line driving circuit 2 are described with reference to FIGS. 5 and 6.

Figure 5:
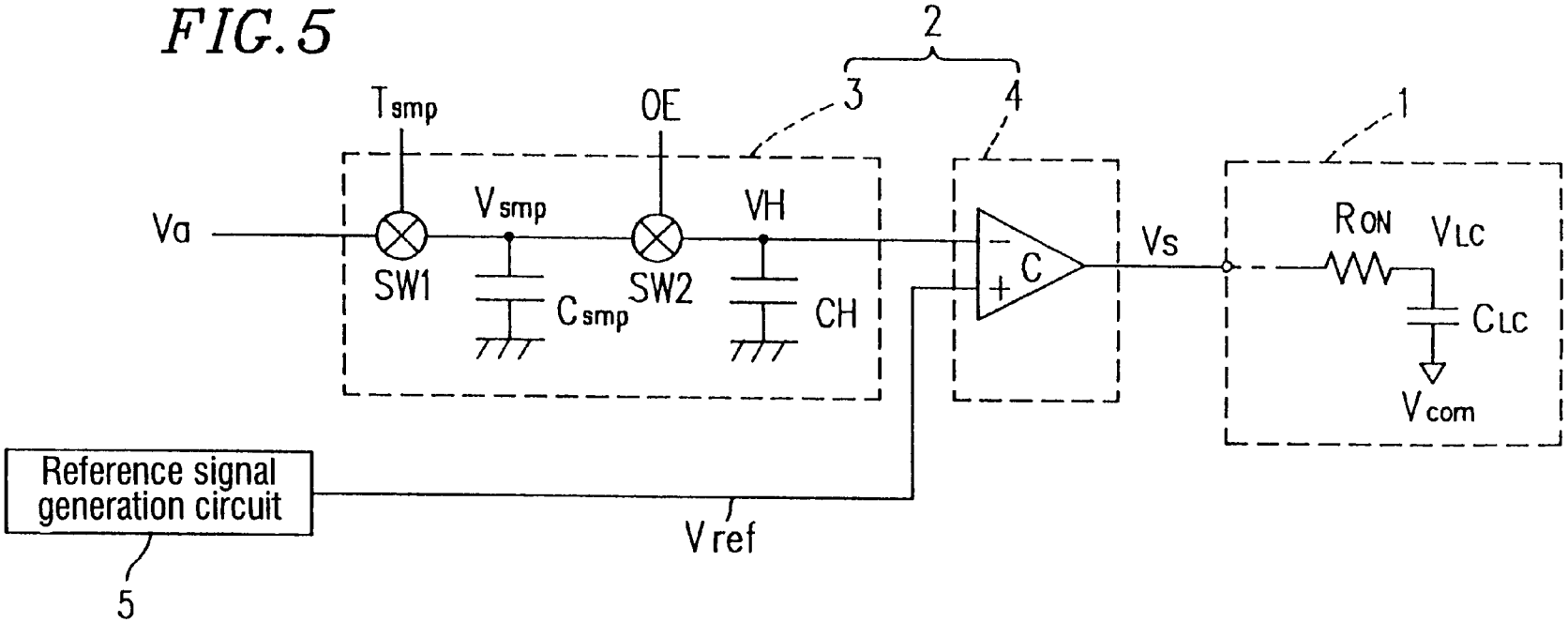
FIG. 5 is a diagram showing the specific configuration of the signal line driving circuit according to Example 1.

As shown in FIG. 5, the signal line driving circuit 2 includes a sample and hold circuit 3 and a comparison circuit 4. The sample and hold circuit 3 receives the analog video signal Va, the sampling pulse Tsmp, and the output pulse OE. The comparison circuit 4 receives the output of the sample and hold circuit 3 and a reference signal Vref from a reference signal generation circuit 5. The output Vs of the comparison circuit 4 is coupled to the display panel 1.

The sample and hold circuit 3 includes an analog switch SW1, SW2, a sampling capacitor Csmp, and a hold capacitor CH. The sampling capacitor Csmp is designed so as to have a sufficiently large capacitance as compared with that of the hold capacitor CH.

The comparison circuit 4 has input terminals of plus (+) and minus (−). The comparison circuit 4 is composed of a comparator operating as follows: when the voltage applied to the plus terminal of the comparison circuit 4 is higher than that applied to the minus terminal thereof, the output Vs equals VSL; when the voltage applied to the plus terminal is lower than that applied to the minus terminal, the output Vs equals VSH.

The analog video signal Va is coupled to the analog switch SW1, which is controlled to be on or off by the sampling pulse Tsmp. The sampling capacitor Csmp is connected between the analog switches SW1 and SW2. The capacitor Csmp is connected to the hold capacitor CH and the minus terminal of the comparison circuit 4 via the analog switch SW2, which is controlled to be on or off by the output pulse OE. The reference signal Vref from the reference signal generation circuit 5 is coupled to the plus terminal of the comparison circuit 4.

Next, the specific operation of the signal line driving circuit 2 will be described. The analog video signal Va is sampled at the sampling capacitor Csmp by controlling the analog switch SW1 with the sampling plus Tsmp, and results in a voltage Vsmp of the sampling capacitor Csmp. Thus, the analog video signal Va has been sampled. Since the sampling capacitor Csmp is designed so as to have a sufficiently large capacitance as compared with that of the hold capacitor CH, the voltage Vsmp of the sampling capacitor Csmp is retained in the hold capacitor CH as a voltage VH when the analog switch SW2 is turned on by the output pulse OE. The retained voltage VH is substantially equal to the sampled voltage Vsmp.

Figure 6:
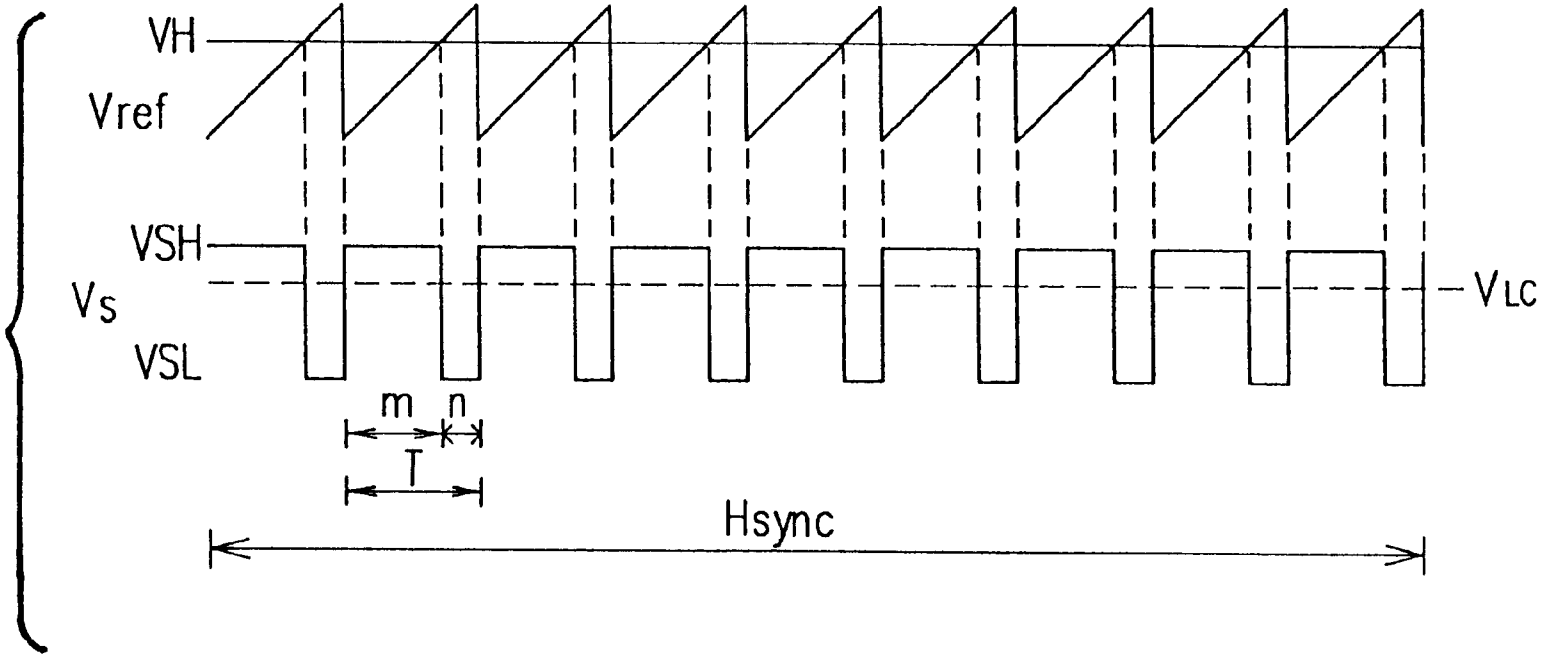
FIG. 6 is a waveform diagram showing a waveform obtained by the signal line driving circuit according to Example 1.

The reference voltage Vref generated by the reference signal generation circuit 5 has a sawtooth-shaped waveform having a period of T, as shown in FIG. 6. The reference voltage Vref is input to the plus terminal of the comparison circuit 4. As shown in FIG. 6, the comparison circuit 4 conducts a comparison operation for the reference voltage Vref and the retained voltage VH, so as to output the pulse signal Vs having two voltage levels of VSH and VSL to the display panel 1. Thus, the comparison circuit 4 outputs the voltage VSH in the regions represented as m in FIG. 6, where the retained voltage VH is larger than the reference voltage Vref, and outputs the voltage VSL in the regions represented as n in FIG. 6, where the retained voltage VH is smaller than the reference voltage Vref. The pulse signal Vs is output to the display panel 1, and is averaged by the low-pass filter characteristics thereof, owing mainly to an ON resistance Ron×Clc of the switching elements. Accordingly, the corresponding pixel is charged with the average voltage VLC of $(m \cdot VSH+n \cdot VSL)/(m+n)$.

Finally, the operation of the signal line driver 200 as a whole will be briefly described with reference to FIGS. 7 and 8. The signal line driver 200 is composed of a plurality of signal line driving circuits 2 of the configuration shown in FIG. 5.

Figure 7:
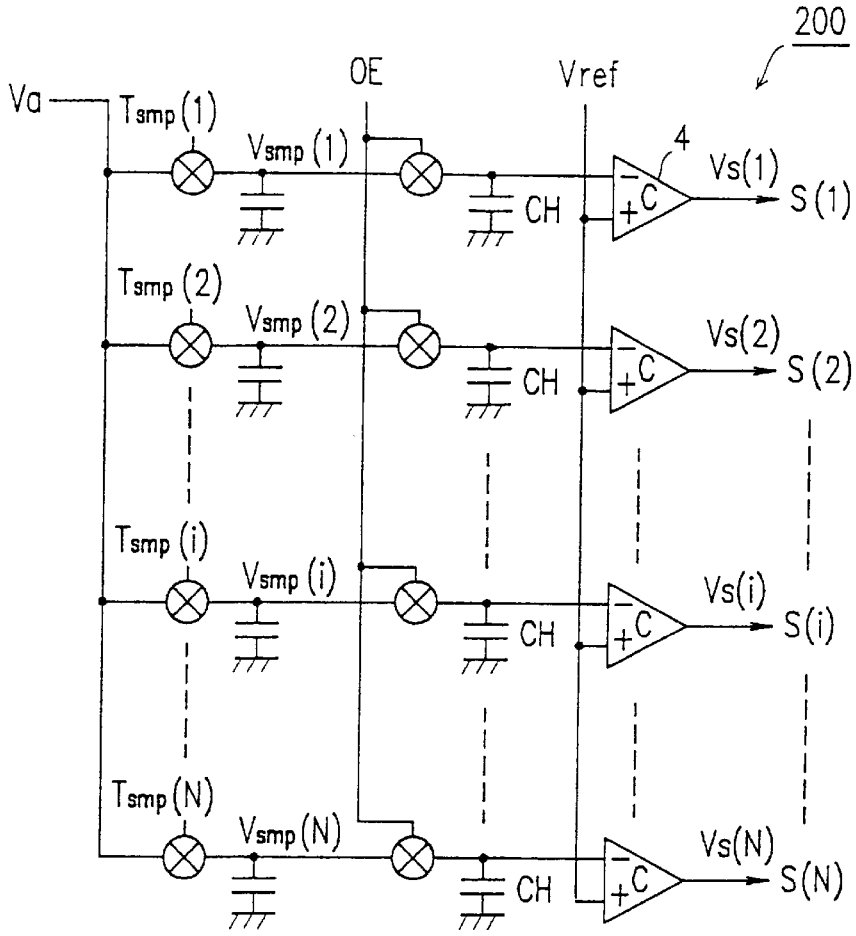
FIG. 7 is a diagram showing the configuration of a signal line driver of the active matrix type display device according to Example 1.
Figure 8:
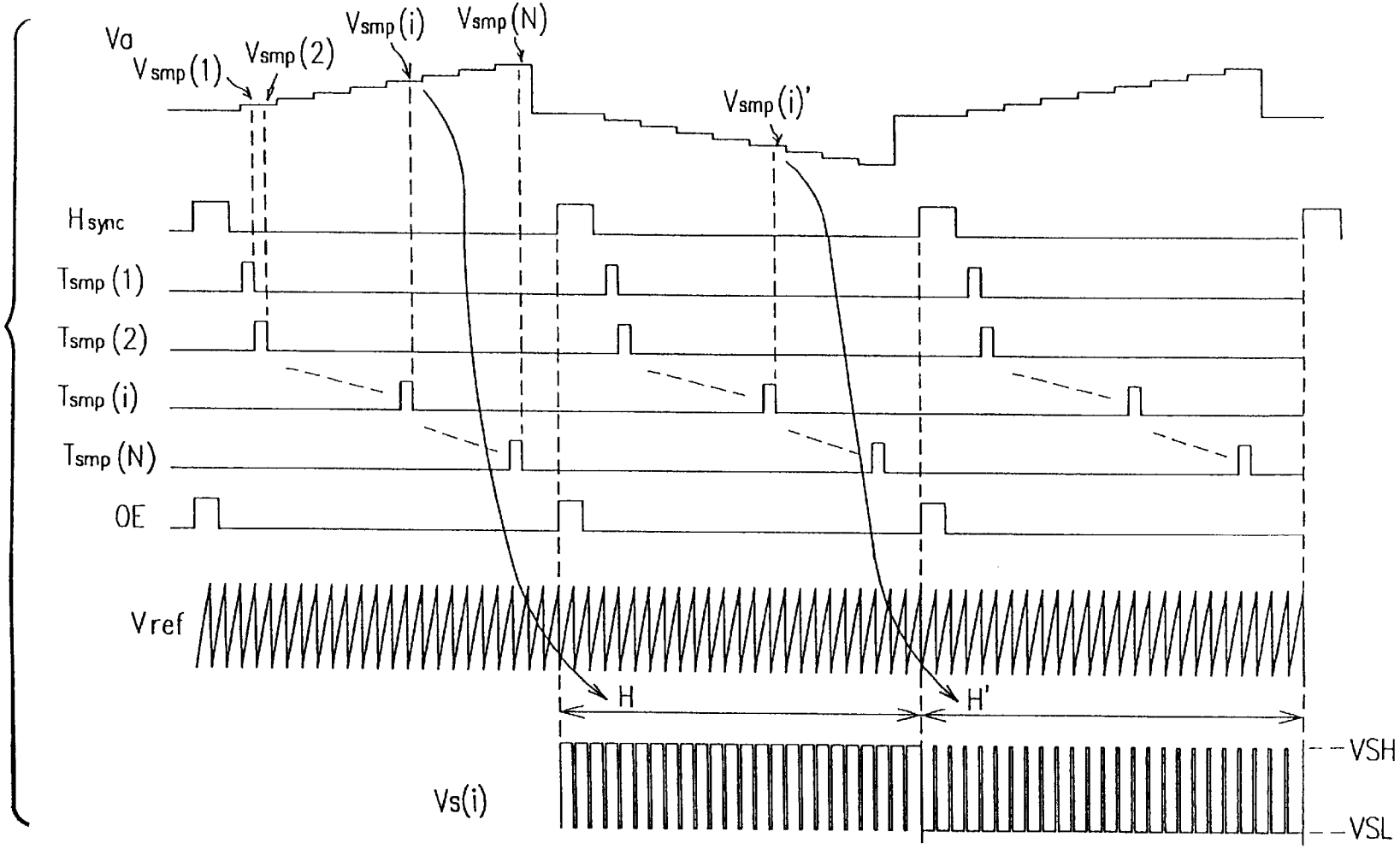
FIG. 8 is a waveform diagram describing an operation of the signal line driver shown in FIG. 7.

FIG. 7 shows the configuration of the signal line driver 200 of the active matrix type display device 10 of the present example. FIG. 8 shows the output waveform of the signal line driving circuit 2 corresponding to an $i^{th}$ signal line 104. As shown in FIG. 7, the signal line driver 200 includes the signal line driving circuits 2 (shown in FIG. 5) in such a manner as to correspond to the respective signal lines S(1) to S(N).

In the signal line driver 200, the input analog video signal Va is sequentially sampled in accordance with the sampling pulses Tsmp(1), Tsmp(2), . . . , Tsmp(i), . . . and Tsmp(N), which are input to the analog switches SW1 of the respective signal line driving circuits 2. As a result, voltages corresponding to the respective signal lines S(1), S(2), . . . , S(i), . . . and S(N) are sampled.

After completing the sampling of the analog video signal for one horizontal scanning period, the sampled voltages Vsmp(1), Vsmp(2), . . . , Vsmp(i), . . . and Vsmp(N) are transferred to the respective hold capacitors CH as the output pulse Oe is input to the analog switches SW2 of the respective signal line driving circuits 2. The voltages retained in the hold capacitors CH are sequentially compared with the reference voltage Vref by the comparison circuits 4 of the respective signal line driving circuits 2, and output to the respective signal lines S(1) to S(N).

In the signal line driving circuit 2 corresponding to the $i^{th}$ signal line, the voltage of the analog video signal Va corresponding to the $i^{th}$ signal line is sampled, in accordance with the sampling pulse Tsmp(i), in the sampling capacitor Csmp(i) as the sampled voltage Vsmp(i). Thereafter, the sampled voltage Vsmp(i) is transferred to the hold capacitor CH in accordance with the output pulse OE, and is compared with the reference voltage Vref by the comparison circuit 4. As a result, a pulse signal as shown in FIG. 8 is output to the signal line S(i). The sampled voltage Vsmp(i)' corresponds to the above-mentioned Vsmp(i) but after one horizontal scanning period.

In accordance with the display device 10 of the present example having the above-mentioned configuration, the duty ratio (m:n) of the pulse signal Vs of each signal line driving circuit 2 varies as the retained voltage VH varies in response to the change in the analog video signal Va. As a result, the pixels can be charged with voltages equal or corresponding to the analog video signal Va. Thus, full-color display can be attained with a simple configuration.

Since the transmission characteristics of the signal paths from the signal line driving circuits 2 to the pixels acting as a low-pass filter for the above-mentioned pulse signals are utilized, there is no need to separately incorporate a low-pass filter. Thus, the configuration of the device can be simplified.

As described above, the unnecessary capacitances and resistances due to the signal lines, which inevitably accompany the display device 10 of this structure, are utilized as a low-pass filter in the present example. However, it is also applicable to adapt the characteristics of the display device to the driving method according to the present invention by arranging the design of the entire display device 10 or adding a particular filter circuit and/or element, thereby imparting the display device 10 with the optimum low-pass filter characteristics for the averaging of the pulse signals of the signal line driving circuits.

EXAMPLE 2

Figure 10:
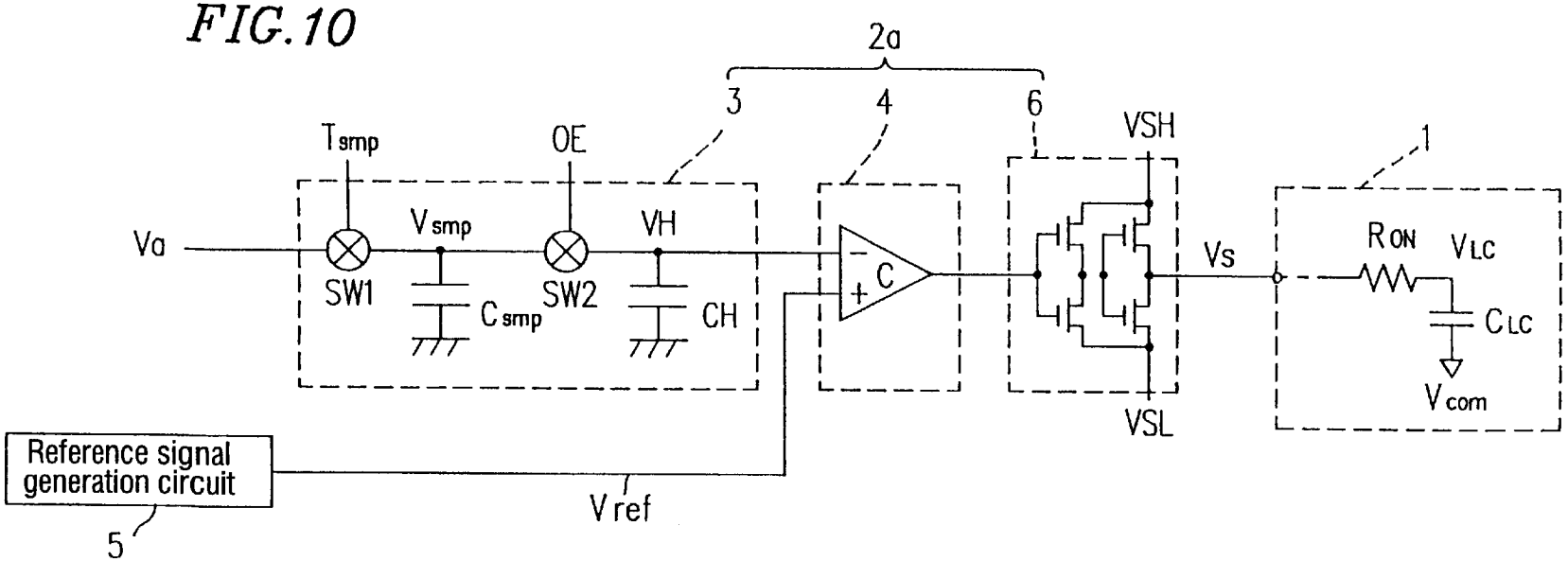
FIG. 10 is a diagram showing the configuration of a signal line driver of the active matrix type display device according to Example 2.

FIG. 10 is a diagram describing an active matrix type display device according to Example 2 of the present invention. As in FIG. 5, FIG. 10 shows one signal line driving circuit 2*a* in a signal line driver of the display device.

As shown in FIG. 10, the signal line driving circuit 2*a* includes a digital buffer circuit 6 coupled to the output of a comparison circuit 4 in the same signal line driving circuit 2 as that of Example 1. This buffer circuit 6 receives two voltage values VSH and VSL. The output signal of the comparison circuit 4 drives signal lines via the buffer circuit 6.

Next, the function and effect of the display device 10 of the present example will be described.

In Example 1, for example, the pulse signal of each signal line driving circuit is averaged by utilizing the low-pass filter characteristics consisting of the time constant Ron×Clc of the corresponding pixel and the like, so as to apply voltages corresponding to the analog video signal Va to the pixels. However, in some types of display panels, the low-pass filter characteristics based on the time constant Ron×Clc of the corresponding pixel and the like may not sufficiently average the pulse signals, thereby degrading the display quality.

In Example 2, the signal line driving circuit 2*a* includes a digital buffer circuit 6 in an output stage side thereof. By prescribing or adjusting the output impedance of the buffer circuit 6 to be a desired value, it becomes possible to adjust the low-pass filter characteristics of the paths from the outputs of the signal line driving circuits 2*a* to the pixels, whereby the display quality can be improved.

EXAMPLE 3

Figure 11:
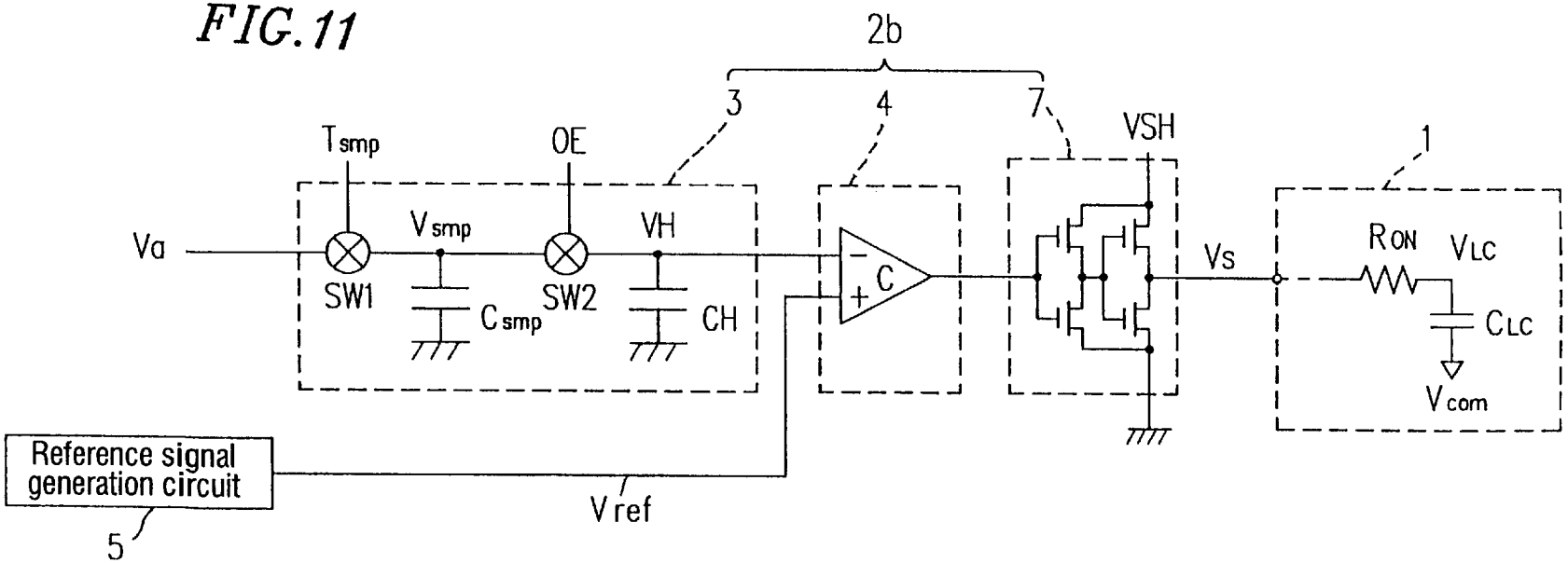
FIG. 11 is a diagram showing the configuration of a signal line driver of the active matrix type display device according to Example 3.
Figure 12:
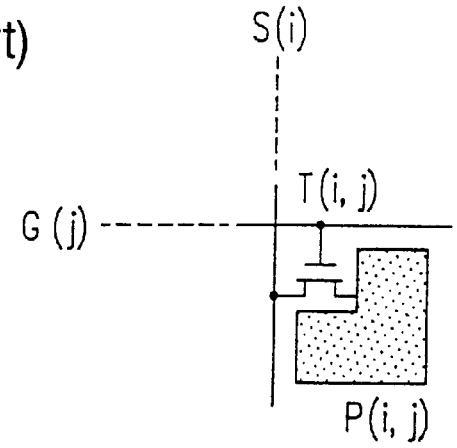
FIG. 12 (Prior Art)
FIG. 12 is a diagram showing one pixel included in an active matrix type liquid crystal panel.
Figure 13:
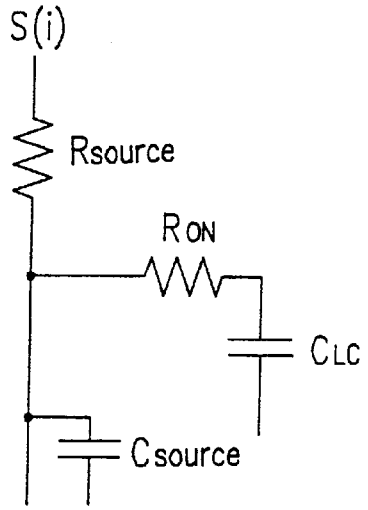
FIG. 13 (Prior Art)
FIG. 13 is a diagram showing an equivalent circuit of one pixel included in an active matrix type liquid crystal panel.

FIG. 11 is a diagram describing an active matrix type display device according to Example 3 of the present invention. As in FIG. 5, FIG. 11 shows one signal line driving circuit 2*b* in a signal line driver of the display device.

As shown in FIG. 11, the signal line driving circuit 2*b* includes a digital buffer circuit 7. The difference between the buffer circuit 6 of Example 2 and the buffer circuit 7 of the present example is that the buffer 7 receives GND, instead of VSL, in addition to VSH. The output signal of the comparison circuit 4 drives signal lines via the buffer circuit 7 as in Example 2.

Therefore, the pulse signals provided by the signal line driving circuits 2*b* of the present example have two voltage levels of VSH and GND. The averaged voltages to be applied to the pixels are voltages such as $VT=m\cdot VSH/(m+n)$, corresponding to an analog video signal Va.

By thus configurating the display device, it becomes possible to omit the external voltage VSL, thereby allowing further reduction in cost and power consumption.

EXAMPLE 4

Figure 25:
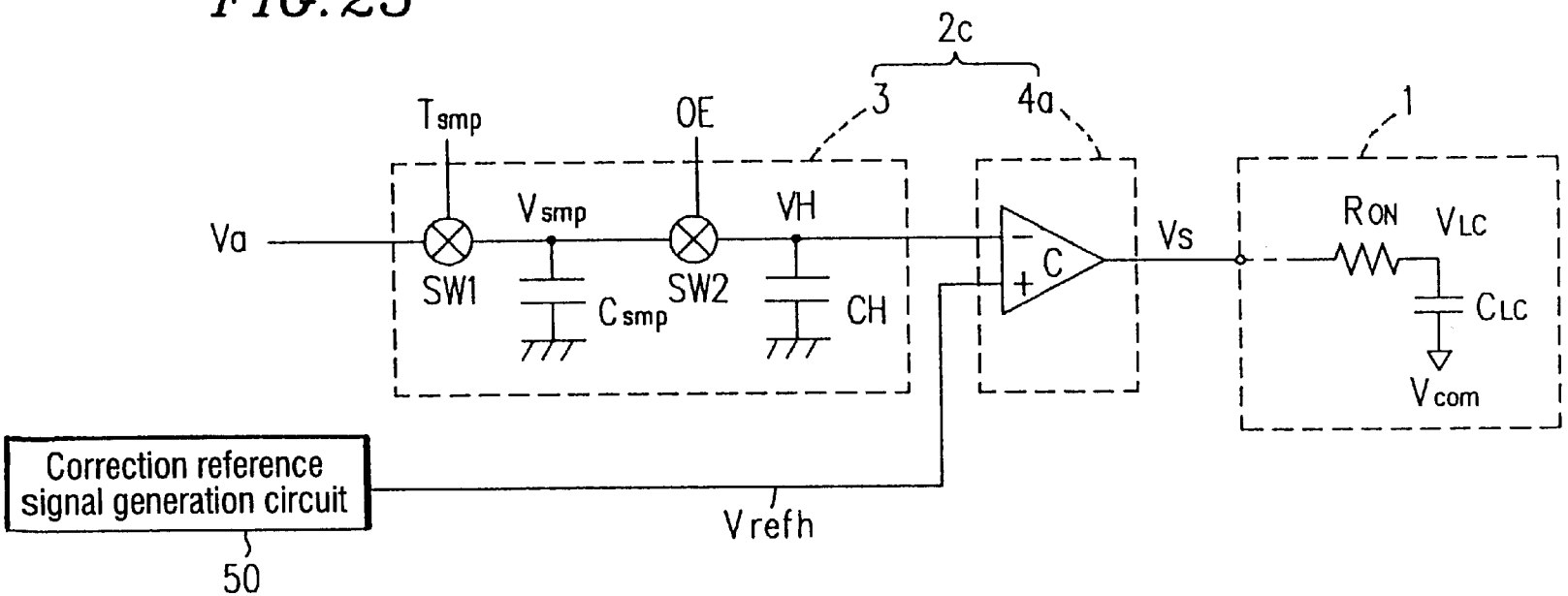
FIG. 25 is a diagram showing the specific configuration of a signal line driving circuit of an active matrix type display device according to Example 4 of the present invention.
Figure 26:
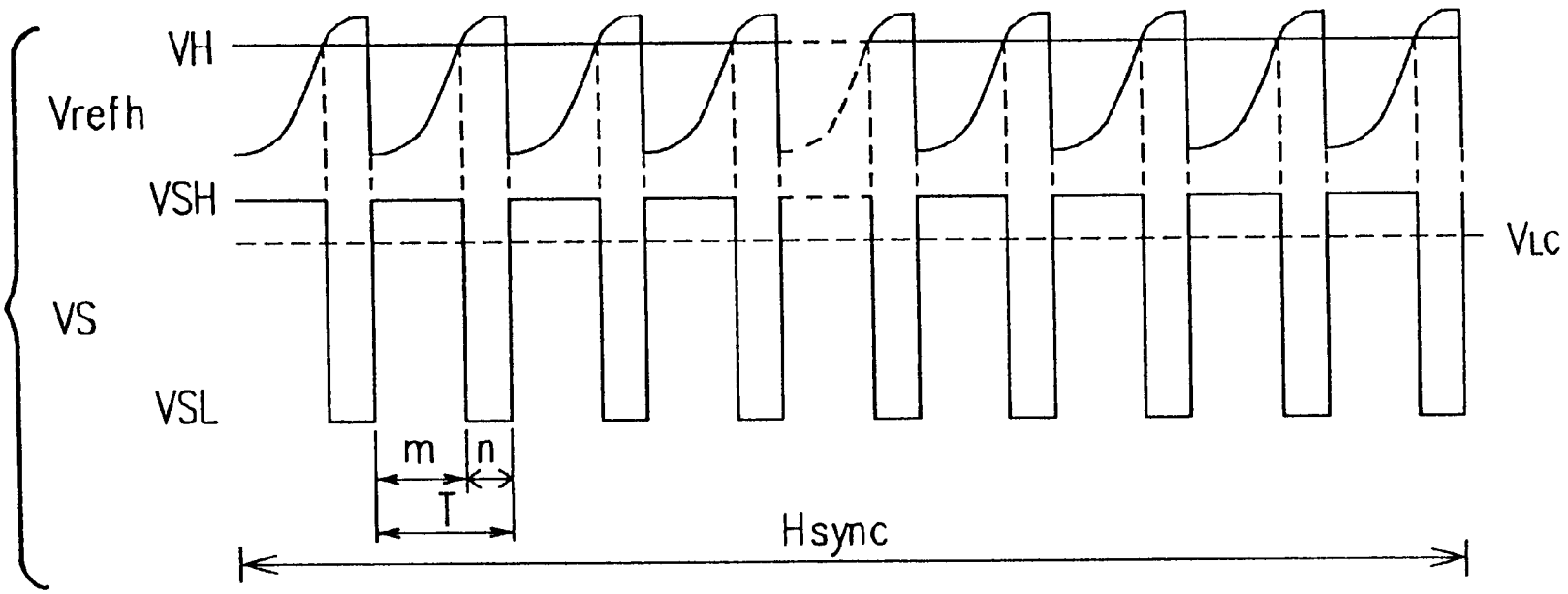
FIG. 26 is a waveform diagram showing a waveform obtained by the signal line driving circuit according to Example 4.
Figure 27:
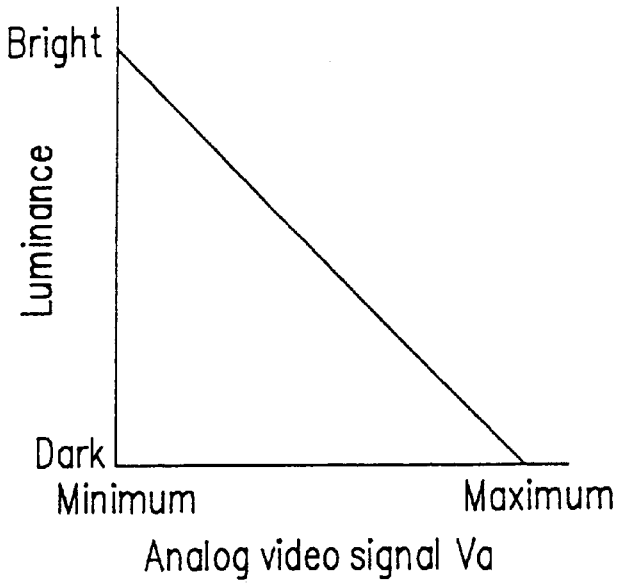
FIG. 27 is a diagram showing the relationship between an analog video signal and display luminance due to liquid crystal according to Example 4.

FIG. 25 is a diagram describing an active matrix type display device according to Example 4 of the present invention. As in FIG. 5, FIG. 25 shows one signal line driving circuit 2*c* in a signal line driver of the display device. FIG. 26 is a waveform diagram showing the respective waveforms of a pulse signal output by the signal line driving circuit 2*c*, and a correction reference signal Vrefh to be input to a comparison circuit 4*a* of the signal line driving circuit 2*c*. FIG. 27 is a diagram showing the relationship between an analog video signal and display luminance due to liquid crystal according to the present example.

In FIG. 25, reference numeral 50 denotes a correction reference signal generation circuit for generating the correction reference signal Vrefh, which takes into account the non-linear relationship between a voltage applied to liquid crystal and the display luminance due to the liquid crystal. To a plus terminal of the comparison circuit 4*a* of the signal line driving circuit 2*c*, the correction reference signal Vrefh is input, instead of a reference signal having a sawtooth shape as that used in Example 1.

Figure 23:
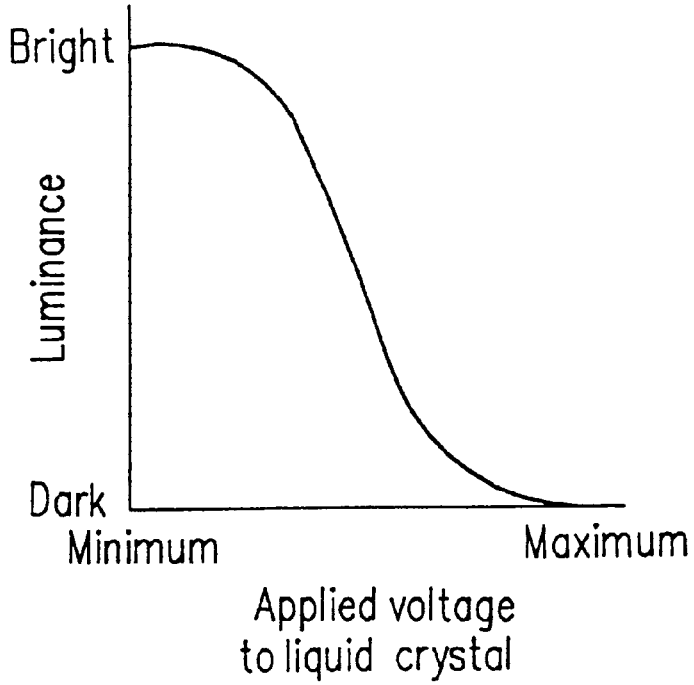
FIG. 23 (Prior Art)
FIG. 23 is a diagram showing the luminance characteristics against voltages applied to the liquid crystal of a liquid crystal display device.
Figure 24:
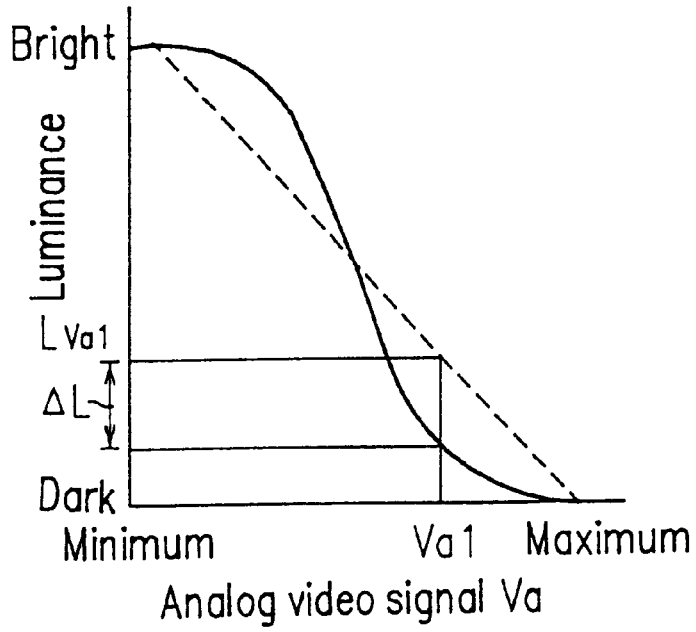
FIG. 24 is a diagram showing a luminance offset due to the luminance characteristics of liquid crystal against an analog video signal.

As shown in FIG. 23, the transmittance characteristics of liquid crystal, i.e., the relationship between the luminance of a liquid crystal display panel and a voltage applied to the liquid crystal are not linear; that is, the change in luminance per a unit change in the voltage applied to the liquid crystal is not constant. Therefore, as shown in FIG. 24, if the analog video signal Va itself is input to the signal line driving circuit 2 in Example 1, the analog video signal Va may have a luminance offset of $\Delta L$ at level Va1, for example. This results in the actual display being darker by $\Delta L$ than the luminance Lva1 corresponding to level Va1 of the original analog video signal Va.

In the present example, as shown in FIG. 26, the output of a sample and hold circuit 3 (FIG. 25) corresponding to the analog video signal Va is compared with the correction reference signal Vrefh, and the signal lines of a display panel 1 are driven by a pulse signal Vs having a duty ratio in accordance with the comparison results. The correction reference signal Vrefh is such that, when an average value of the pulse signal Vs having a duty ratio corresponding to the comparison results (to be larger or smaller) with the analog video signal Va is applied to liquid crystal, the analog video signal Va achieves linear relationship with the luminance due to the liquid crystal, as shown in FIG. 27.

In accordance with the display device 10 of the present example having the above-mentioned configuration, the following advantages are provided in addition to those obtained according to Example 1: The sampled values of the analog video signal Va are compared with the correction reference signal Vrefh, which takes into account the non-linear relationship between a voltage applied to liquid crystal and the display luminance due to the liquid crystal, and an average voltage level of a pulse signal Vs having a duty ratio in accordance with the comparison results is applied to the pixel electrode constituting each pixel, thereby ensuring that linear relationship holds between the analog video signal and the luminance due to the liquid crystal. As a result, it becomes possible to prevent luminance offsets due to the non-linear relationship the voltage applied to liquid crystal and the display luminance due to the liquid crystal and the display luminance due to the liquid crystal without incorporating a high-speed analog correction circuit for correcting the analog video signal in view of the non-linear relationship.

EXAMPLE 5

Figure 28:
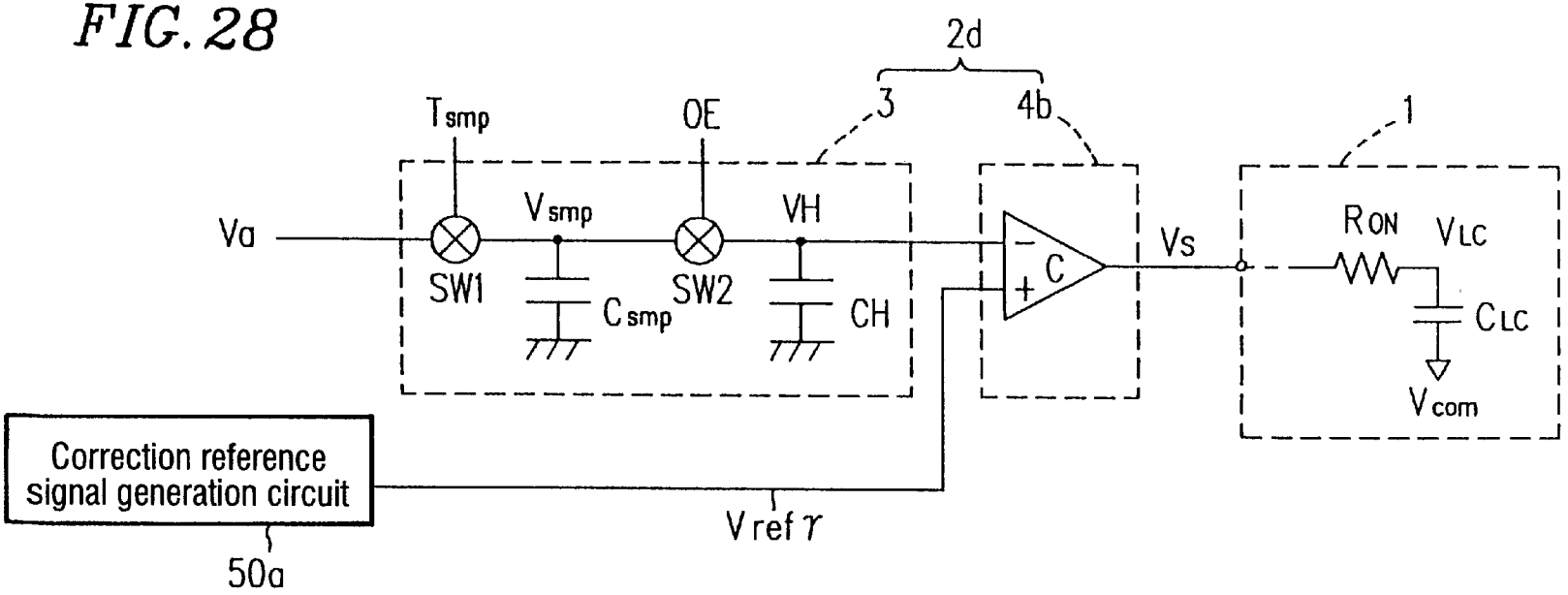
FIG. 28 is a diagram showing the specific configuration of a signal line driving circuit of an active matrix type display device according to Example 5 of the present invention.

FIG. 28 is a diagram describing an active matrix type display device according to Example 5 of the present invention. As in FIG. 5, FIG. 28 shows one signal line driving circuit 2*d* in a signal line driver of the display device.

In FIG. 28, reference numeral 50*a* denotes a correction reference signal generation circuit for generating a correction reference signal Vref$\gamma$, which takes into account a $\gamma$ correction, to which a television video signal is subjected. To a plus terminal of a comparison circuit 4*b* of the signal line driving circuit 2*d*, the correction reference signal Vref$\gamma$ is input, instead of a reference signal having a sawtooth shape as that used in Example 1.

Among various analog video signals authentic video signals for television broadcast, e.g., an NTSC type, are subjected to a $\gamma$ correction ($\gamma=1/2.2$) on the transmission side so that the display on a cathode ray tube attains $\gamma=1$, thereby preventing luminance offsets in the luminance of the cathode ray tube with respect to the video signal. As a result, the burden on the image receiving tube is reduced. The $\gamma$ correction may be defined as a video-signal correction carried out for a television signal on the transmission side in order to correct the radiation luminance of a cathode ray tube-type television.

The transmittance characteristic (luminance characteristics) of liquid crystal with respect to an input video signal voltage (voltage applied to liquid crystal) are different from the radiation luminance characteristics of a cathode ray tube with respect to a video signal. Therefore, if a television video signal is input to a liquid crystal display device without being corrected on the liquid crystal display device side, the gray-scale luminance characteristics are not properly reproduced by the liquid crystal display device, thereby resulting in unsatisfactory display images.

In the present example, as shown in FIG. 28, the output of a sample and hold circuit 3 corresponding to the above-mentioned analog video signal Va is compared with the correction reference signal Vrefγ, and signal lines of a display panel 1 are driven by a pulse signal Vs having a duty ration in accordance with the comparison results. The correction reference signal Vrefγ is such that, when an average value of the pulse signal VS having a duty ration corresponding to the comparison results with the analog video signal Va subjected to the γ correction is applied to liquid crystal, display is achieved based on proper gray-scale luminance characteristics, with the γ correction having been corrected.

In accordance with the display device of the present example having the above-mentioned configuration, the following advantages are provided in addition to those obtained according to Example 1: The sampled values of the analog video signal Va are compared with the correction reference signal Vrefγ, which takes into account the γ correction performed for television video signals, and an average voltage level of a pulse signal Vs having a duty ratio in accordance with the comparison results is applied to the pixel electrode constituting each pixel, thereby ensuring that display is achieved based on proper gray-scale luminance characteristics, with the γ correction having been corrected. As a result, even when an analog video signal, e.g., that of the NTSC type, is input to a liquid crystal display device, it is possible to obtain optimum display images on the liquid crystal display device without being influenced by the γ correction, which is performed for television video signals on the transmission side or the sake of display using cathode ray tubes.

EXAMPLE 6

Figure 31:
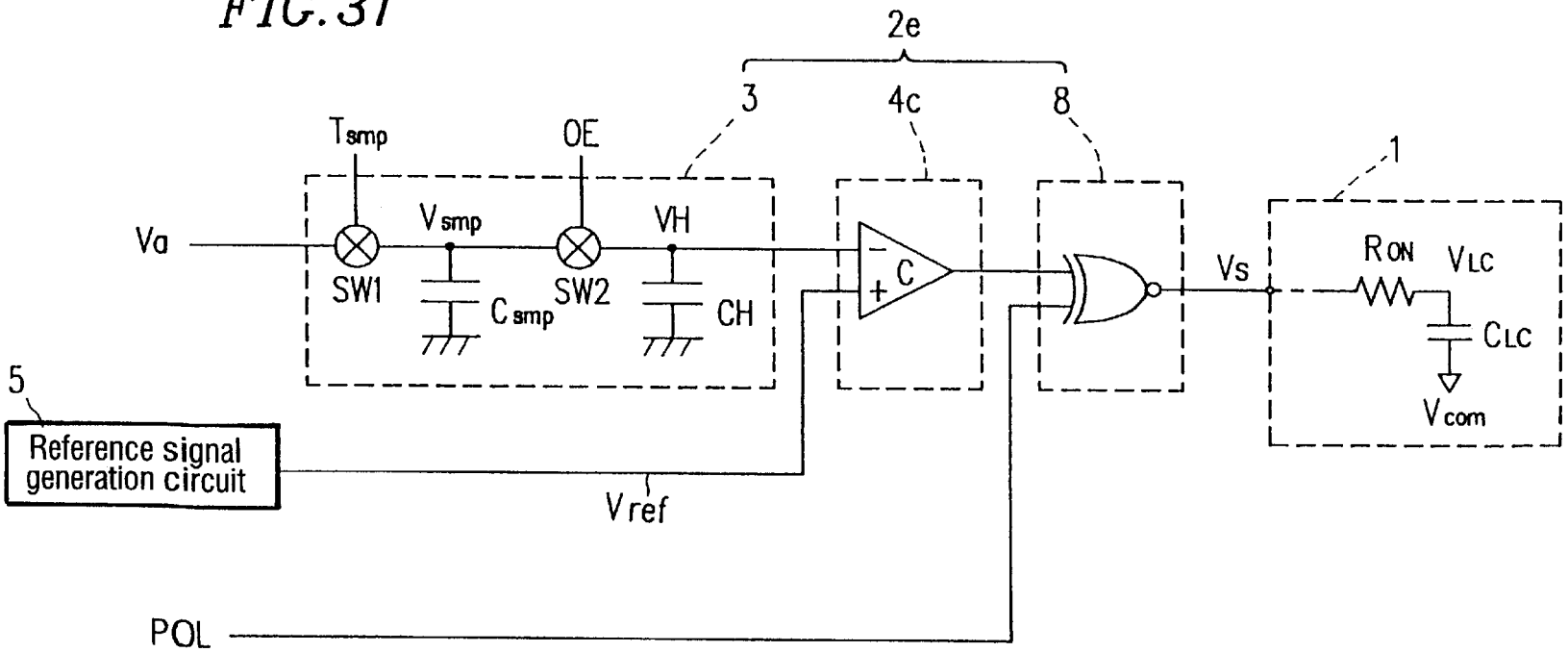
FIG. 31 is a diagram showing the specific configuration of a signal line driving circuit of an active matrix type display device according to Example 6 of the present invention.
Figure 32:
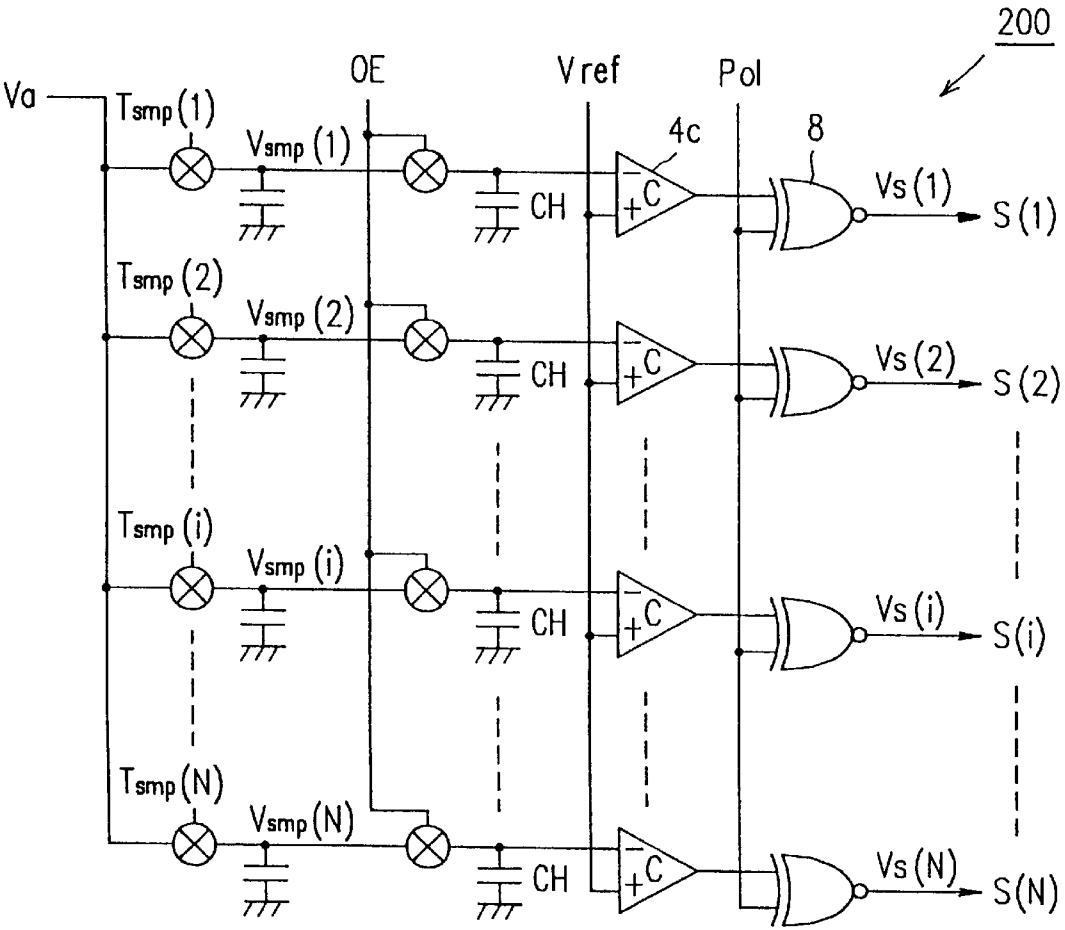
FIG. 32 is a diagram showing the configuration of the signal line driving circuits of an active matrix type display device according to Example 6 of the present invention.
Figure 33:
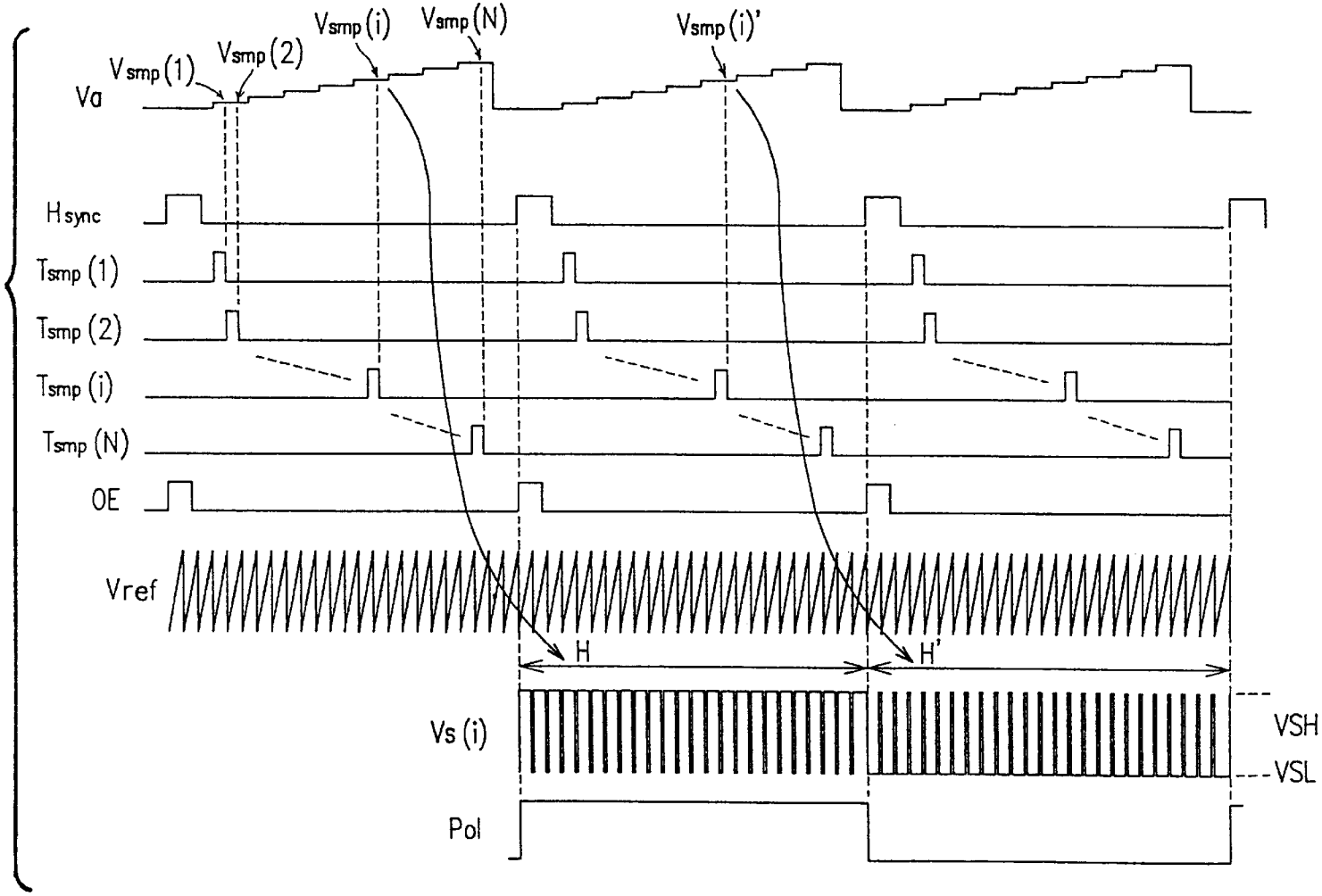
FIG. 33 is a signal waveform diagram describing an operation by the signal line driving circuits shown in FIG. 32.

FIGS. 31 and 32 are diagrams describing an active matrix type display device according to Example 6 of the present invention. FIG. 31, corresponding to FIG. 5, shows one signal line driving circuit 2*e* in a signal line driver of the display device. FIG. 32, corresponding to FIG. 7, shows the entire configuration of a signal line driver 200 composed of a plurality of signal line driving circuits 2*e*. FIG. 33, corresponding to FIG. 8, is a timing diagram showing the output waveform of the signal line driving circuit 2*e* corresponding to an $i^{th}$ signal line of the signal line driver 200. As shown in FIG. 32, the signal line driver 200 includes the signal line driving circuits 2*e* (shown in FIG. 31) in such a manner as to correspond to the respective signal lines S(1) to S(N).

As shown in FIG. 31, a video signal Va is input to the signal line driving circuit 2*e*. The output of a comparison circuit 4C is coupled to one of the input terminals of an EXCLUSIVE NOR gate 8. A polarity inversion signal POL is coupled to the other input of the EXCLUSIVE NOR gate 8. The output of the EXCLUSIVE NOR gate 8 drives the corresponding signal line. When the polarity inversion signal POL is at a high level, the EXCLUSIVE NOR gate 8 outputs the same waveform of as that of the output of the comparison circuit 4C. When the polarity inversion signal POL is at a low level, the EXCLUSIVE NOR gate 8 outputs a waveform obtained by inverting that of the output of the comparison circuit 4C. In other words, the duty ratio of the pulse signal is logically inverted; for example, a duty ratio of m:n would be logically inverted into n:m.

Figure 29:
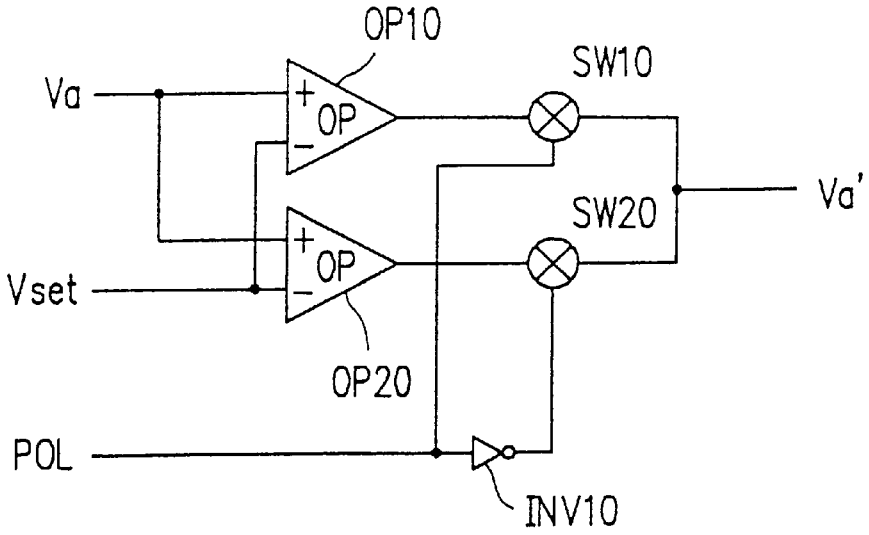
FIG. 29 (Prior Art)
FIG. 29 shows a conventional circuit for generating an analog polarity inversion signal.
Figure 30:
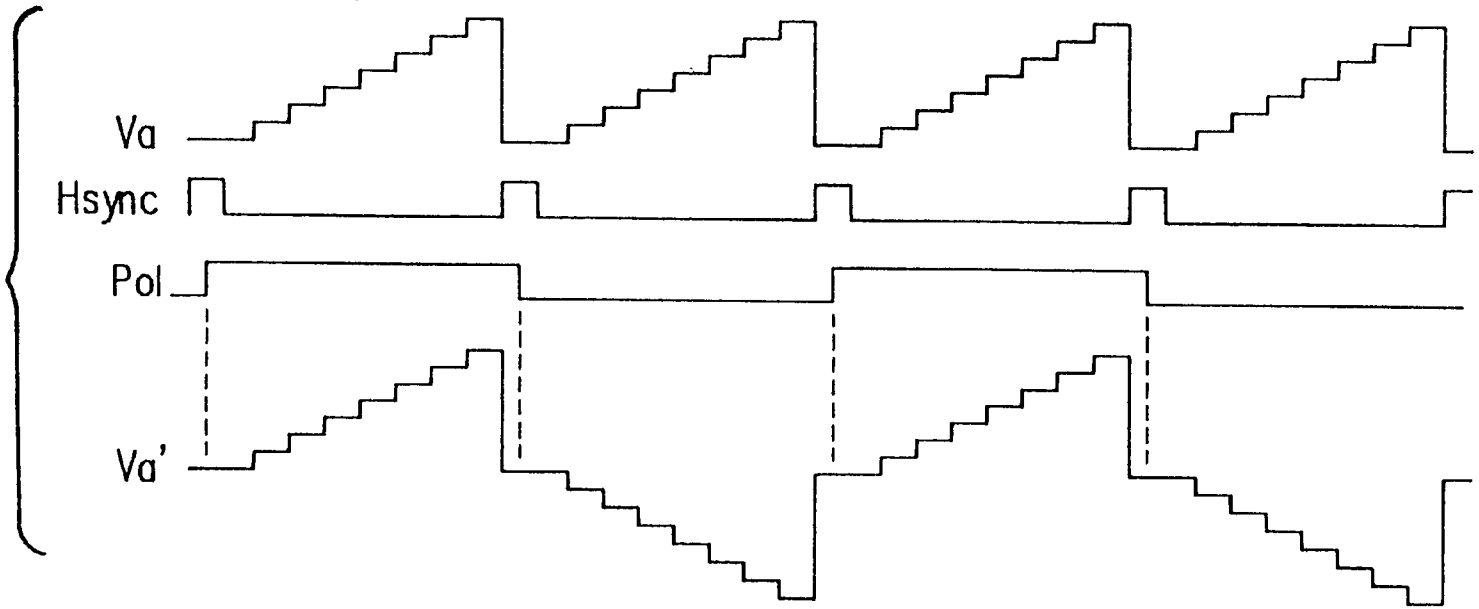
FIG. 30 (Prior Art)
FIG. 30 is a signal waveform diagram describing an operation by the conventional circuit for generating an analog polarity inversion signal shown in FIG. 29.

The video signal Va is a video signal commonly used for display by cathode ray tubes or the like. In the case of a conventional liquid crystal display device or the like which required a.c. driving, it is required to convert the video signal Va into an a.c. signal by a high-speed analog polarity inversion signal generation circuit, such as that shown in FIG. 29, and input the resultant a.c. signal to the signal line driving circuit as the analog video signal Va as shown in FIGS. 8 and 9. However, according to the present invention, a waveform similar to that of the output Vs(i) shown in FIG. 8 can be obtained by simply inputting the video signal Va, as shown in FIG. 33.

EXAMPLE 7

As described in Example 6, the present invention makes it possible to achieve a.c. driving by using simple logic circuitry and prevent a d.c. voltage from being applied to pixels, thereby preventing the deterioration of the liquid crystal material of the pixels. However, in certain types of display panels, the application of a positive voltage and a negative voltage having the same absolute value to a pixel electrode may result in a difference between the absolute values of respective retained voltage levels. In other words, merely inverting the polarity of a video signal may create a difference between the positive and negative voltage levels retained in the pixel. This causes flickering of images, and may develop an after-image phenomenon.

Figure 34:
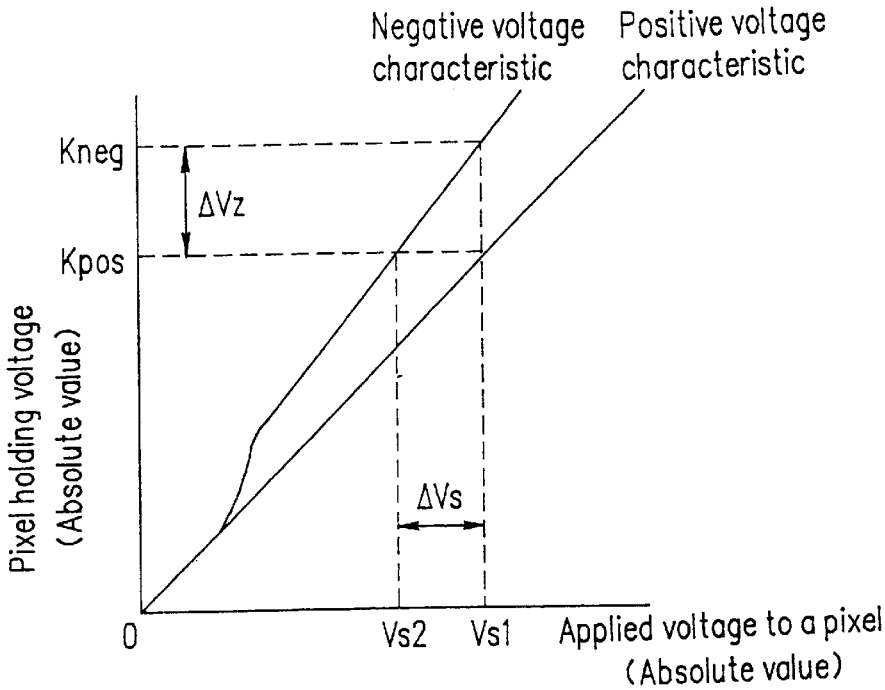
FIG. 34 is a diagram showing positive/negative applied voltage retention characteristics of a display panel.

FIG. 34 is a panel characteristics diagram showing the relationship between voltages retained in a pixel with respect to voltages applied to the pixel. In FIG. 34, the scale of the axis of ordinate is so designed that positive voltages applied to the pixel exhibits linear relationship with the voltages retained in the pixel. Therefore, a positive voltage Kpos is retained in the pixel when a positive voltage Vs1 is applied to the pixel. However, when a negative voltage Vs1 (having the same absolute level as the positive voltage Vs1) is applied to the pixel, a negative voltage Kneg is retained in the pixel, which has a different absolute value from that of a negative voltage Kpso. Thus, there is an offset of ΔVz in the voltage retained in the pixel between the case where the positive voltage Vs1 is applied and the case where the positive voltage Vs1 is applied. In order to ensure that the same voltage value Kpos is retained in the pixel by applying a negative voltage thereto, a negative voltage Vs2, instead of Vs1, should be applied to the pixel.

Figure 35:
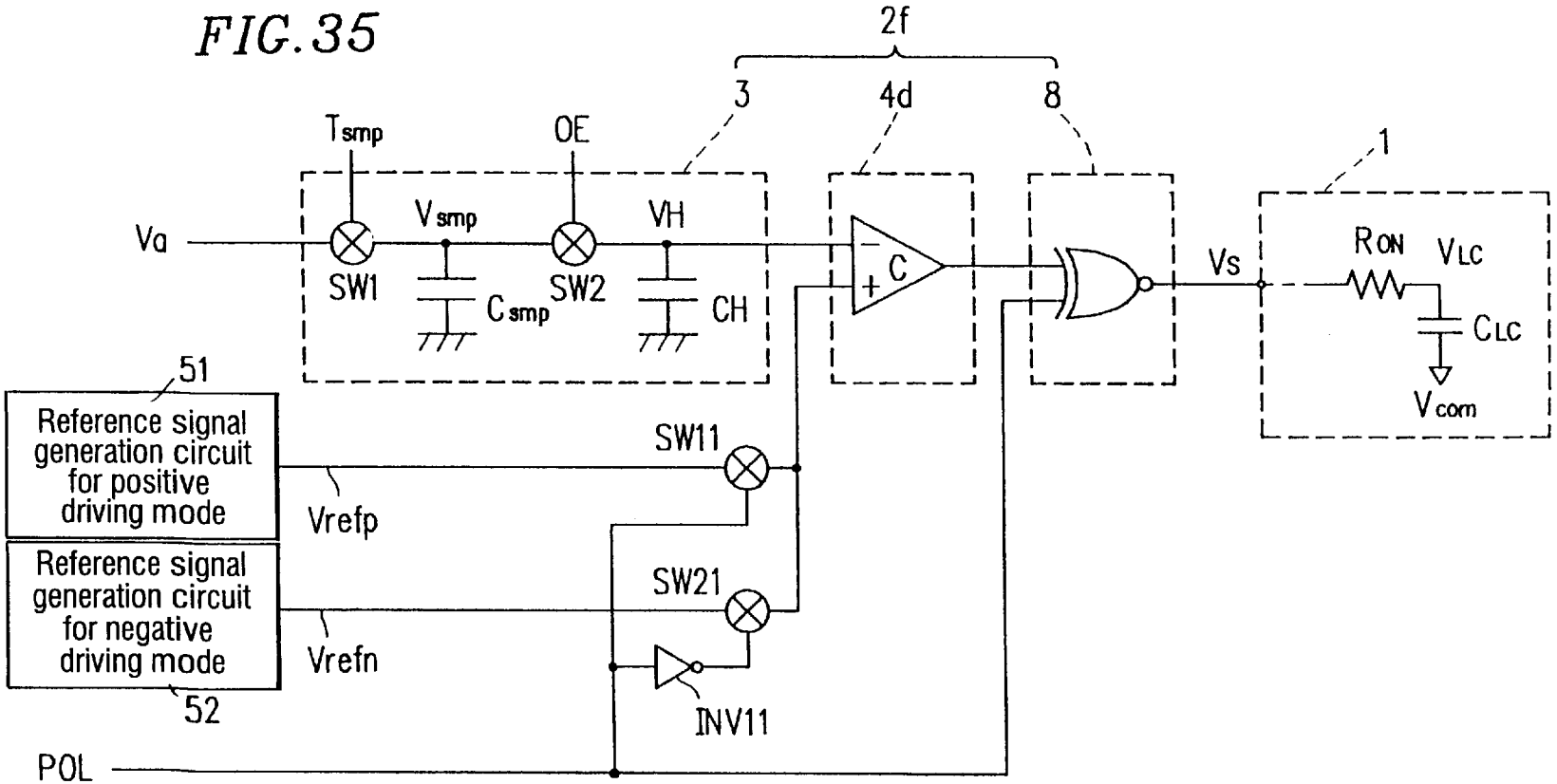
FIG. 35 is a diagram showing the specific configuration of a signal line driving circuit of an active matrix type display device according to Example 7 of the present invention.
Figure 36:
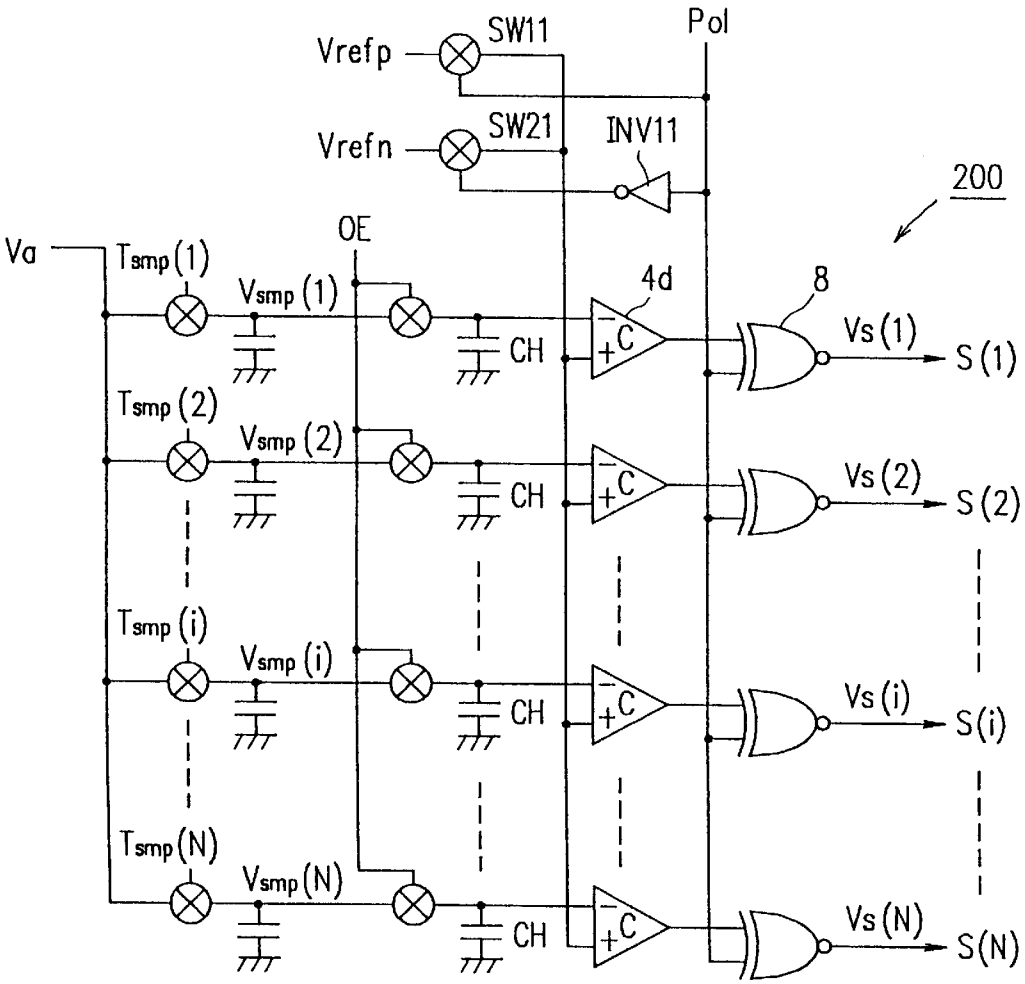
FIG. 36 is a diagram showing the configuration of the signal line driving circuits of an active matrix type display device according to Example 7 of the present invention.
Figure 37:
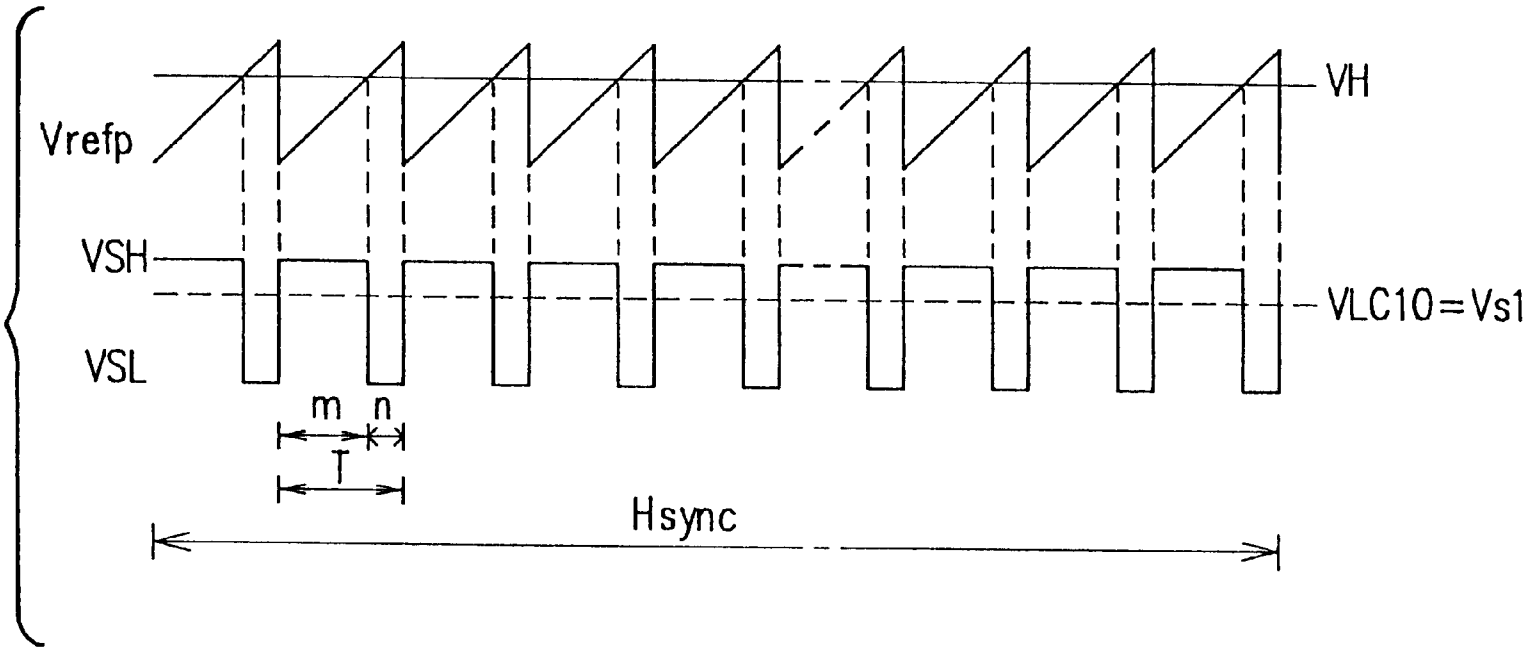
FIG. 37 is a waveform diagram showing a waveform obtained by the signal line driving circuit shown in FIG. 35 when a positive voltage is applied.
Figure 38:
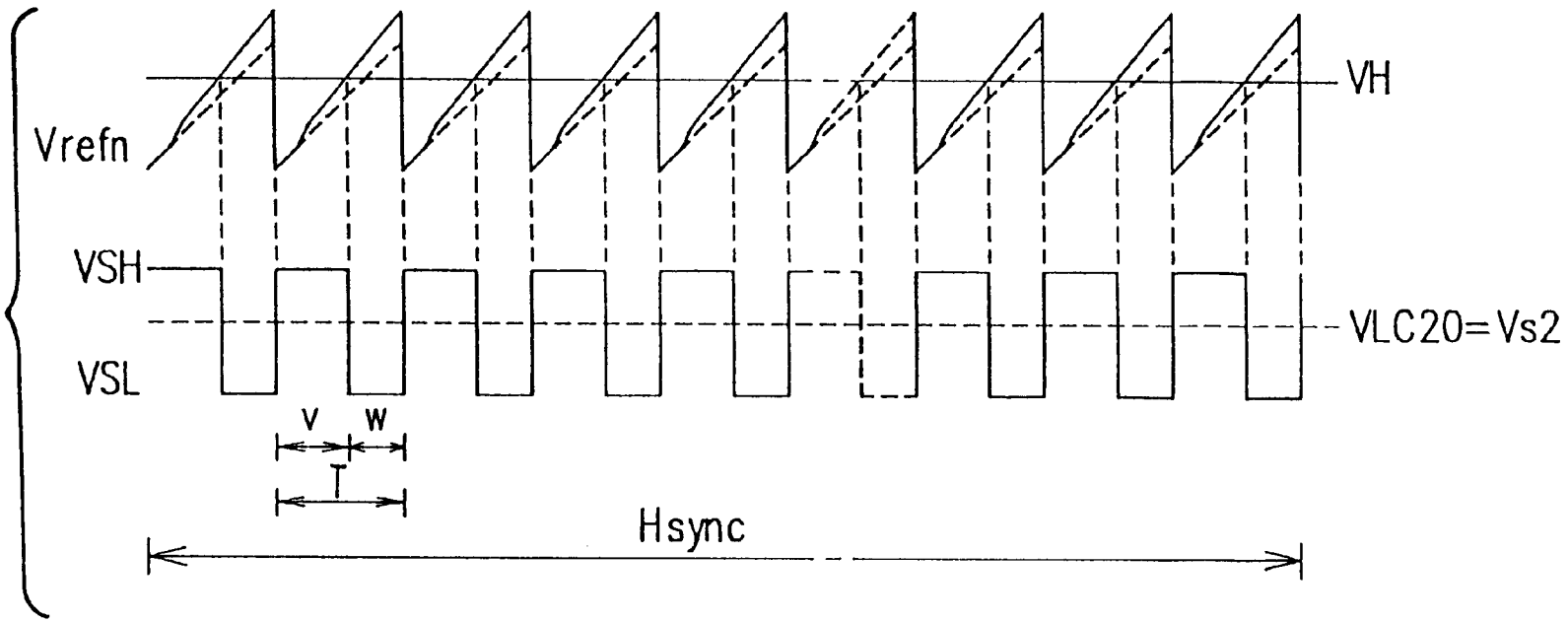
FIG. 38 is a waveform diagram showing a waveform obtained by the signal line driving circuit shown in FIG. 35 when a negative voltage is applied.

FIGS. 35 and 36 are diagrams describing an active matrix type display device according to Example 7 of the present invention. FIG. 35, corresponding to FIG. 5, shows one signal line driving circuit 2f in a signal line driver of the display device. FIG. 36, corresponding to FIG. 7, shows the entire configuration of a signal line driver 200 composed of a plurality of signal line driving circuits 2f. FIG. 37 is a waveform diagram showing a reference signal Vrefp for positive voltages, which is employed in the case of applying a positive voltage to the pixels. FIG. 38 is a waveform diagram showing a reference signal Vrefn for negative voltages, which is employed in the case of applying a negative voltage to the pixels.

As show in FIG. 35, the reference signal Vrefp, which is generated by a reference signal for positive voltages generation circuit 51, is coupled to one of the input terminals of an analog switch SW11; the reference signal Vrefn, which is generated by a reference signal for negative voltages generation circuit 52, is coupled to one of the input terminals of an analog switch SW21. The respective other inputs of the analog switches SW11 and SW21 are coupled to a plus terminal of a comparison circuit 4*d*. The analog switch SW11 is directly controlled by the polarity inversion signal POL, whereas the analog switch SW21 is controlled by a signal obtained by logically inverting the polarity inversion signal POL in an inverter INV11. Accordingly, the reference signal Vrefp for positive voltages is input to the comparison circuit 4*d* as a reference signal when positive voltage is applied to the pixel; the reference signal Vrefn for negative voltages is input to the comparison circuit 4*d* as a reference signal when a negative voltage is applied to the pixel. In the present example, control is so made that, in the case where a positive voltage VS1 is applied to the pixel as shown in FIG. 37, the reference signal Vrefn for negative voltages is generated so that the negative voltage Vs2 is applied to the pixel, thereby compensating for the offset ΔVz of the voltage retained in the pixel when applying a negative voltage as shown in FIG. 38. By thus driving the signal line with the output of an EXCLUSIVE NOR gate 8 controlled by the polarity inversion signal POL, the voltage +Kpos is retained in the pixel when a positive voltage is applied, and the voltage −Kpos is retained in the pixel when a negative voltage is applied. As a result, it is made possible to prevent a d.c. component from being applied to the pixels, and a high-quality display device can be realized free of flickering or the after-image phenomenon.

EXAMPLE 8

Figure 39:
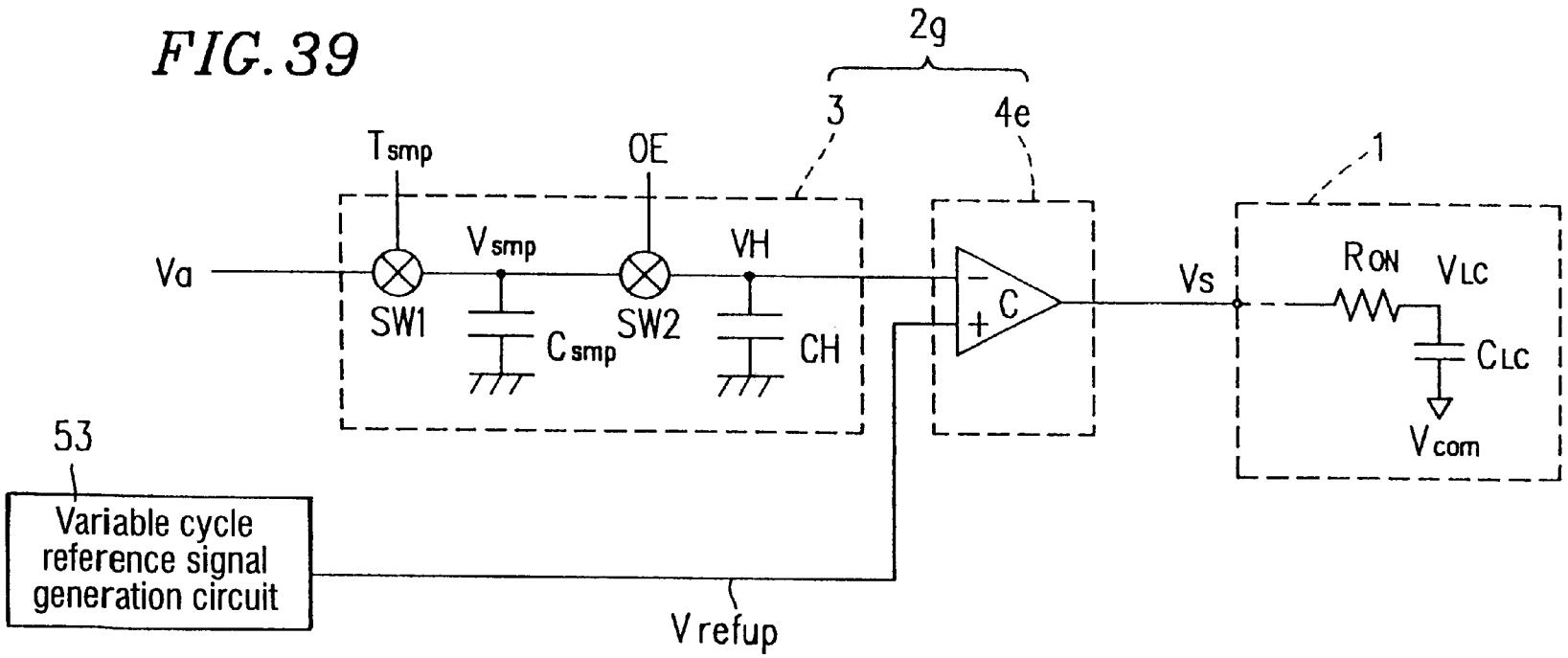
FIG. 39 is a diagram showing the specific configuration of a signal line driving circuit of an active matrix type display device according to Example 8 of the present invention.

FIG. 39 is a diagram describing an active matrix type display device according to Example 8 of the present invention. FIG. 39, corresponding ti FIG. 5, shows one signal line driving circuit 2*g* in a signal line driver of the display device. To a plus terminal of a comparison circuit 4*e* of the signal line driving circuit 2*g*, a variable cycle reference signal Vrefup is input, instead of the reference signal Vref generated by the reference signal generation circuit 5 shown in FIG. 5. The variable cycle reference signal Vrefup is generated by a variable cycle reference signal generation circuit 53.

As described above, the path from the outputs of signal line driving circuits to pixels have the characteristics of a low-pass filter, which are substantially determined by the time constant Ron×Clc of the individual pixels, rather than the time constant Rsource×Csource of the signal lines themselves.

Figure 40:
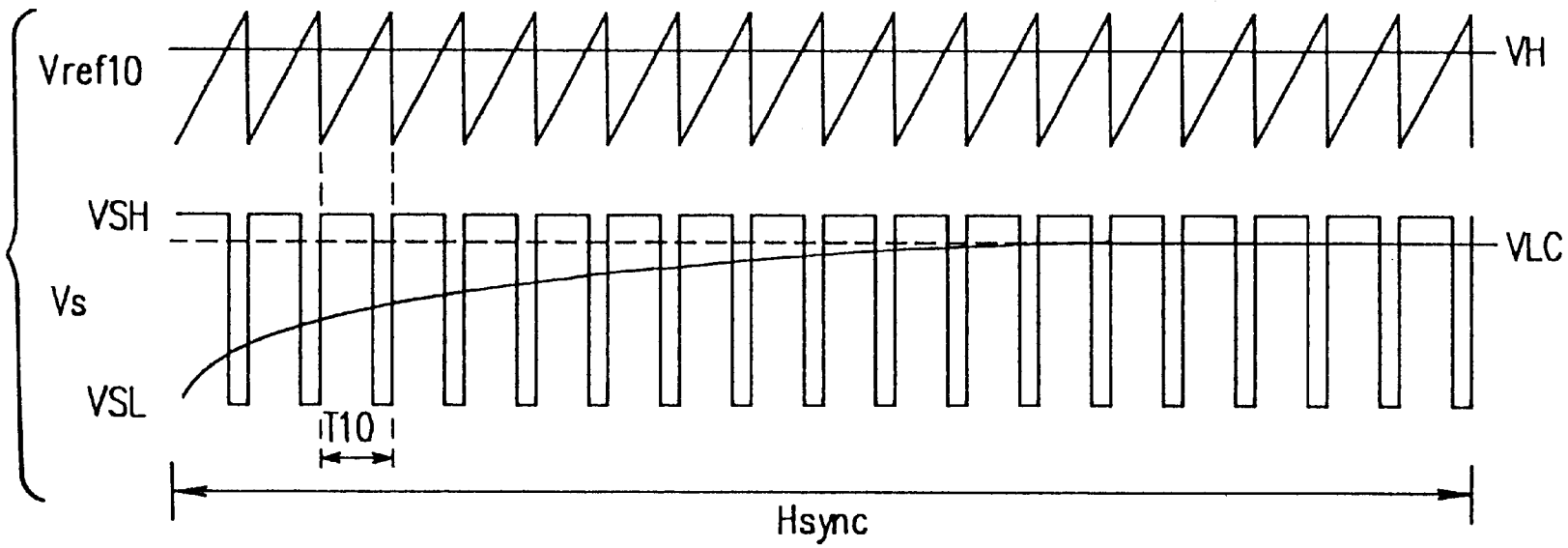
FIG. 40 is a waveform diagram showing a signal waveform when the frequency of a plus signal is adequate.
Figure 41:
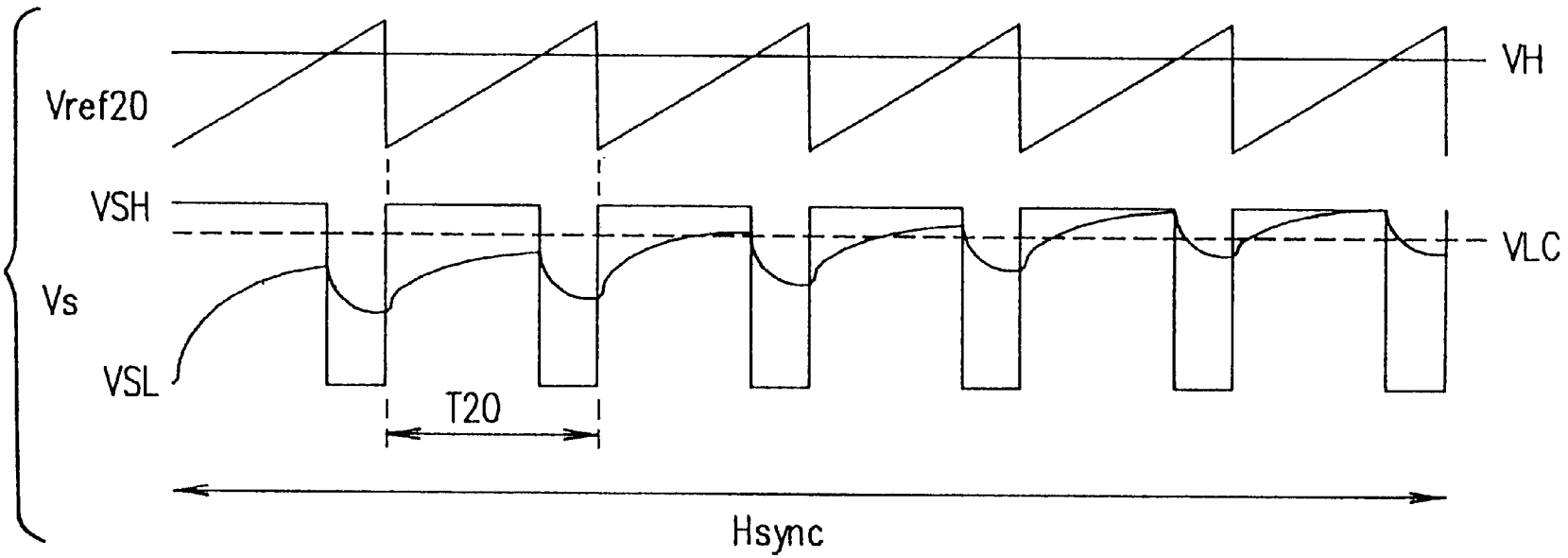
FIG. 41 is a waveform diagram showing a signal waveform when the frequency of a plus signal is not adequate.

Accordingly, in order to apply an average voltage of a pulse signal to a pixel, it is necessary to prescribe the cycle of the pulse signal at such a value that the pulse signal is sufficiently averaged by the above-mentioned low-pass filter, as shown in FIG. 40. However, the signal lines are load capacitors to the signal line driving circuits, so that it is required to repeat charging/discharging of the output of the signal line driving circuit at the same cycle as that of the pulse signal thereof. Accordingly, the power consumption of the signal line driving circuit inevitably increases as the frequency of the pulse signal increases. On the other hand, if the frequency of the pulse signal is too low in view of the low-pass filter characteristics, the pulse signal is not sufficiently averaged as shown in FIG. 41. As a result, an appropriated voltage is not applied to the pixel, thereby degrading the display quality.

Figure 42:
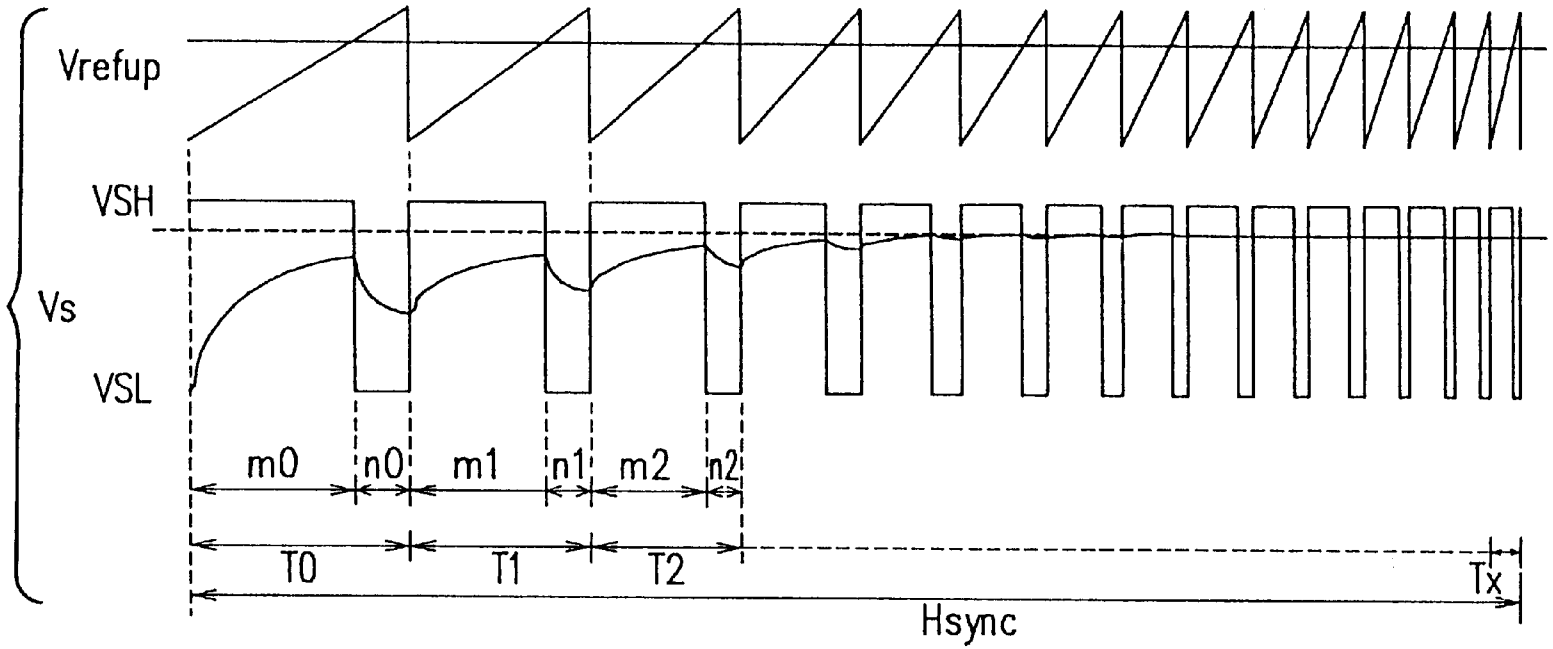
FIG. 42 is a waveform diagram showing a waveform obtained by the signal line driving circuit shown in FIG. 39.

As shown in FIG. 42, the variable cycle reference signal Vrefup generated by the variable cycle reference signal generation circuit 53 is controlled so that the cycle thereof satisfies the following relationship during the same voltage-writing period (i.e., Hsync in the case of the present example);

$$T0 \geqq T1 \geqq T2 \geqq \ldots \geqq Tx \quad \text{(eq. 1)}$$

In other words, the frequency of the variable cycle reference signal Vrefup gradually increases. Accordingly, the cycle of the pulse signal of the signal line driving circuit 2*g* also satisfied eg. 1, and the duty ration thereof satisfies:

$$m0:n0=m1:n1=m2:n2=\ldots=mx:nx \quad \text{(eq. 2)}$$

Therefore, with respect to the same voltage-writing writing period, the frequency of the pulse signal is so low that the pulse signal is not sufficiently averaged when the voltage has just started being applied to the pixel, but the frequency of the pulse signal gradually increases, so that the pulse signal is sufficiently averaged when the application of the voltage to the pixel is complete, as shown in FIG. 40. Therefore, it is not necessary to prescribe the cycle of the pulse signal to be high enough for the pulse signal to be sufficiently averaged by the above-mentioned low-pass filter. As a result, the power consumption of the display device can be reduced.

EXAMPLE 9

Figure 43:
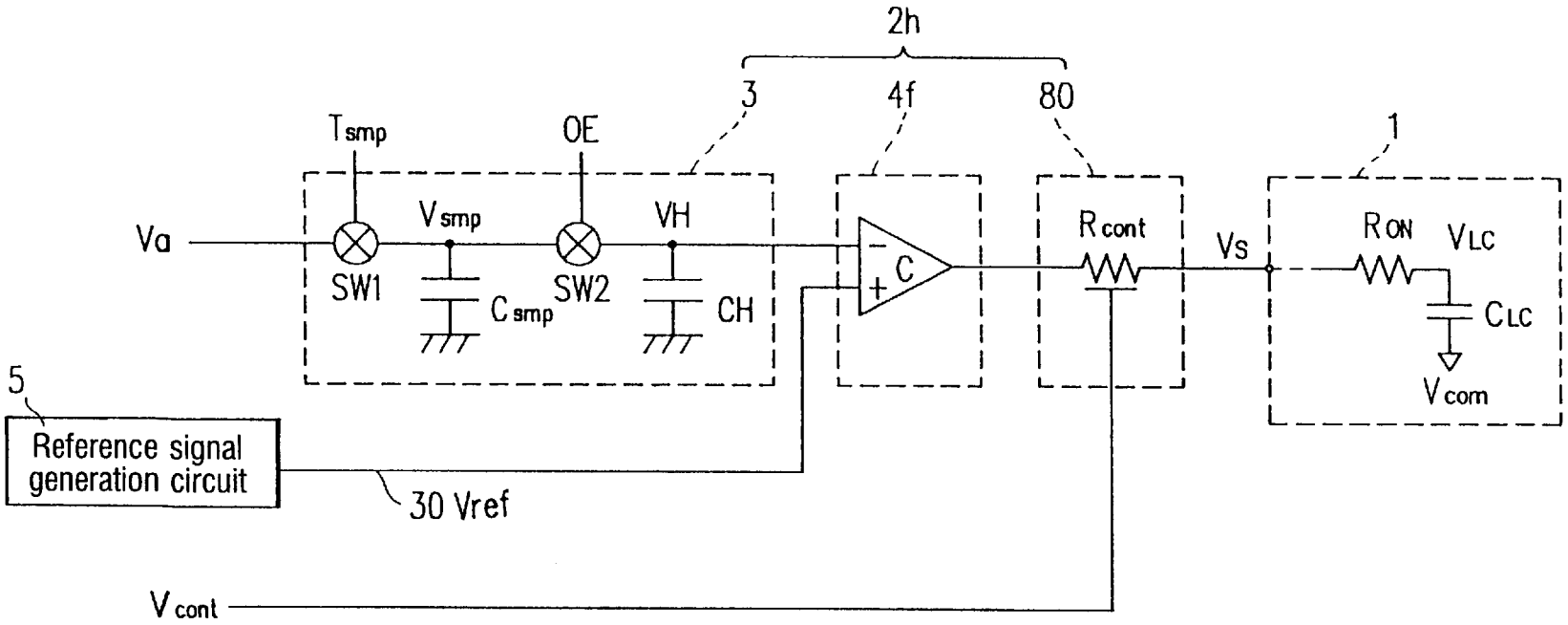
FIG. 43 is a diagram showing the specific configuration of a signal line driving circuit of an active matrix type display device according to Example 9 of the present invention.
Figure 44:
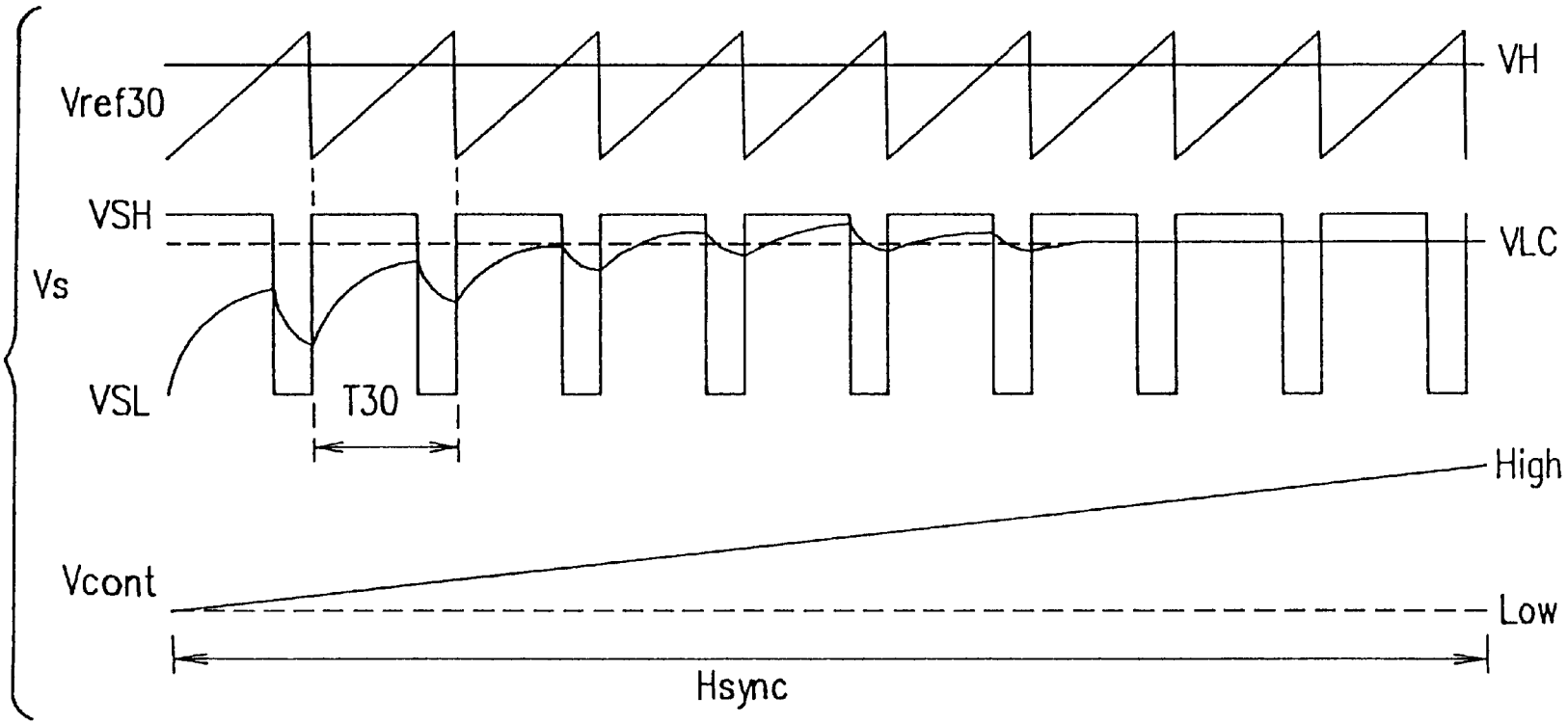
FIG. 44 is a waveform diagram showing a waveform obtained by the signal line driving circuit shown in FIG. 43.

FIG. 43 is a diagram describing an active matrix type display device according to Example 9 of the present invention. FIG. 44 is a waveform diagram for describing the operation of the display device shown in FIG. 43. FIG. 43, corresponding to FIG. 5, shows one signal line driving circuit 2*h* in a signal line driver of the display device. As shown in FIG. 43, in the display device of the present example, the output of a comparison circuit 4*f* is coupled to a signal line via a variable impedance element 80. Therefore, the impedance of a signal path of a pulse signal output from the comparison circuit 4*f* equals the sum of the impedance of the variable impedance element 80 and the impedance of the circuitry from the signal line to a pixel (which are formed in the display panel 1). By adjusting the impedance of the variable impedance element 80, the impedance of the signal path of the pulse signal can be controlled. In other words, the frequency characteristics of the low-pass filter for averaging the pulse signal can be controlled.

A reference signal Vref30 as shown in FIG. 44 is input to a plus terminal of the comparison circuit 4*f* . The variable impedance element 80 shown in FIG. 43 is controlled b a control signal Vcont. In the present example, such control is made that the resistance value of the variable impedance element 80 increases in proportion to the level of the control signal Vcont.

As described above, the path from the outputs of signal line driving circuits to pixels have the characteristics of a low-pass filter, and the characteristics are substantially determined by the time constants Ron×Clc of the individual pixels, rather than the time constant Rsource×Csource of the signal lines themselves. However, in certain types of display panels having small values of Ron and Cls, the frequency of the pulse signal as determined by the cycle T30 of the reference signal Vref30 may be not sufficient to ensure that the voltage applied to the pixel is sufficiently averaged. As a result, an appropriated voltage is not applied to the pixel, thereby degrading the display quality. On the other hand, the pulse signal can be sufficiently average by simply increasing the output impedance of each signal line driving circuit, but it is impossible to reach the desired voltage value within the same voltage-writing period in this case.

According to the present example, the output of the comparison circuit 4*f* is coupled to the signal line via the variable impedance element 80 having a resistance Rcont. Therefore, the low-pass filter characteristics are determined by a time constant (Rcont+Ron)×Clc, rather than the time constant Ron×Clc of the individual pixels. Consequently, as shown in FIG. 44, control is so made that the level of the control signal Vcont gradually increases within the same voltage-writing period (i.e., Hsync in the case of the present example), so that the resistance value Rcont of the variable impedance element 80 also gradually increases. Thus, it becomes possible to sufficiently average the voltage applied to the pixel and to reach the desired voltage value even in the case of a display panel having such low values of Ron and Clc that the frequency of the pulse signal as determined by the cycle T30 of the reference signal Vref30 cannot ensure that the voltage applied to the pixel is sufficiently averaged, preventing an appropriated voltage from being applied to the pixel.

EXAMPLE 10

Figure 45:
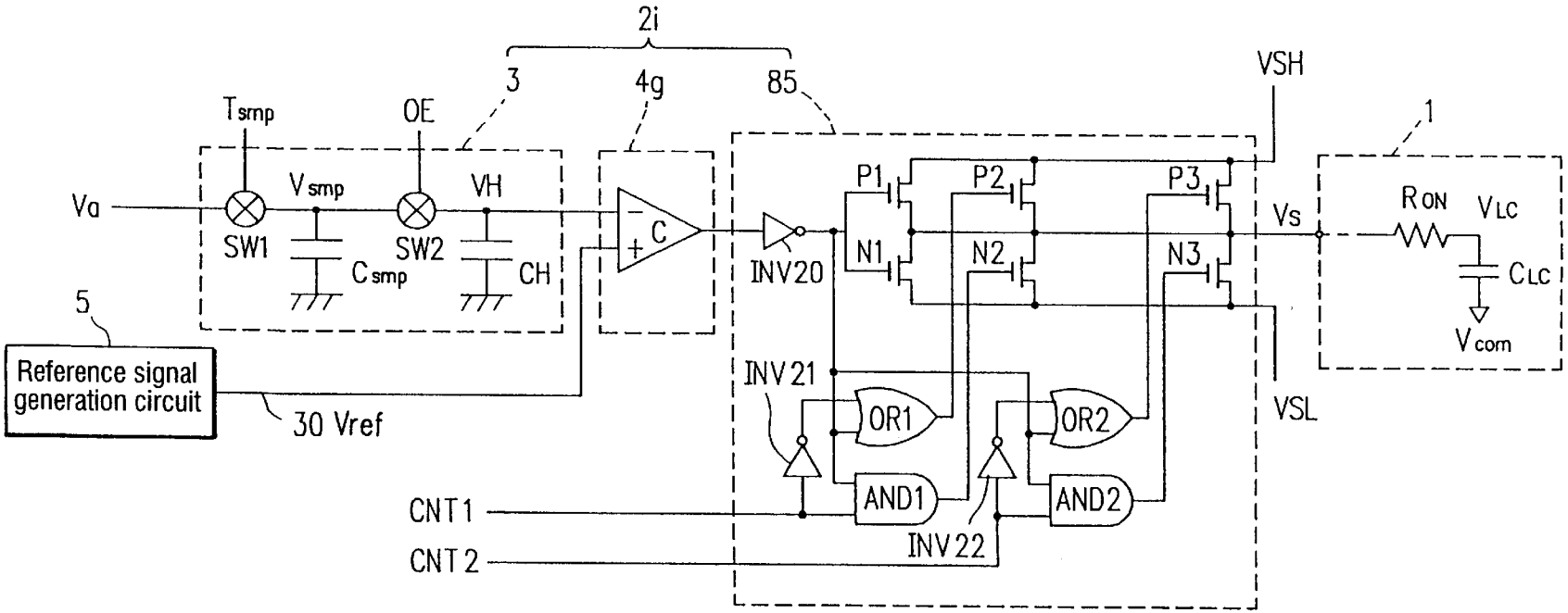
FIG. 45 is a diagram showing the specific configuration of a signal line driving circuit of an active matrix type display device according to Example 10 of the present invention.
Figure 46:
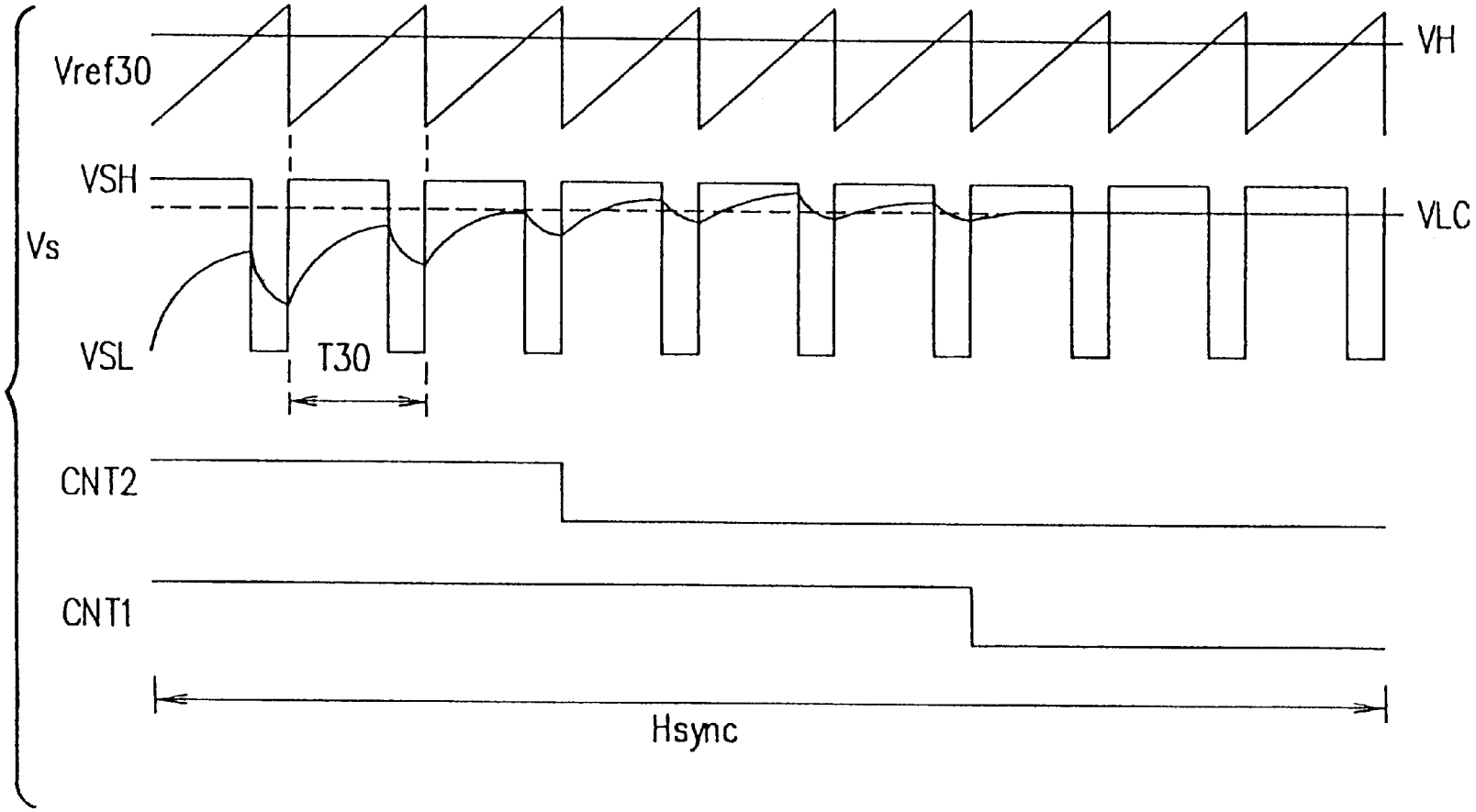
FIG. 46 is a waveform diagram showing a waveform obtained by the signal line driving circuit shown in FIG. 45.

FIG. 45 is a diagram describing an active matrix type display device according to Example 10 of the present invention. FIG. 45, corresponding to FIG. 43 employed in Example 9, shows one signal line driving circuit 2*i* in a signal line driver of the display device. Table 1 illustrates the operation of an output buffer circuit 85 of the signal line driving circuit 21 having the configuration shown in FIG. 45. FIG. 46 is a waveform for describing the operations of the signal line driving circuit 2*i* shown in FIG. 45.

TABLE 1

| CNT1 | CNT2 | Output of comparator 4 g | P1 | P2 | P3 | N1 | N2 | N3 |
|---|---|---|---|---|---|---|---|---|
| High | High | High | ON | ON | ON | OFF | OFF | OFF |
| High | High | Low | OFF | OFF | OFF | ON | ON | ON |
| High | Low | High | ON | ON | OFF | OFF | OFF | OFF |
| High | Low | Low | OFF | OFF | OFF | ON | ON | OFF |
| Low | Low | High | ON | OFF | OFF | OFF | OFF | OFF |
| Low | Low | Low | OFF | OFF | OFF | ON | OFF | OFF |

As shown in FIG. 45, according to the present example, the output of a comparison circuit 4*g* is coupled to a signal line via the variable impedance output buffer 85. A reference signal Vref30 is input to a plus terminal of the comparison circuit 4*g* as in Example 9. The variable impedance output buffer 85 is controlled by control signals CNT1 and CNT2. The variable impedance output buffer 85 includes: a first buffer composed of a PMOS transistor P1 and an NMOS transistor N1; a second buffer composed of a PMOS transistor P2 and an NMOS transistor N2; a third buffer composed of a PMOS transistor P3 and an NMOS transistor N3; and logical elements. i.e., inverters INV20, INV21, and INV22, and gates AND1 and AND2, and OR gates OR1 and OR2.

As seen from Table 1, the variable impedance output buffer 85 operates as follows.

When the control signals CNT1 and CNT2 are both at a high level, the first buffer, the second buffer, and the third buffer all operate so as to drive the signal line.

When the control signals CNT1 is at a high level and CNT2 is at a low level, the first buffer and the second buffer operate so as to drive the signal line. The PMOS transistor P3 and the NMOS transistor N3 of the third buffer are in an off-state irrespective of the output of the comparison circuit 4*g*, so that the third buffer is not involved in the driving of the signal line.

When the control signals CNT1 and CNT2 are both at a low level, the PMOS transistor P2 and the NMOS transistor N2 of the second buffer, and the PMOS transistor P3 and the NMOS transistor N3 of the third buffer are all in an off-state irrespective of the output of the comparison circuit 4*g*, so that neither the second buffer nor the third buffer is involved in the driving of the signal line. Only the first buffer operates so as to drive the signal line.

Since a buffer circuit composed of PMOS and NMOS transistors has some output impedance due to the ON resistance of the MOS transistors, so that the output impedance of the output circuit can be varied depending on the number of output buffers which drive the signal line at the same.

As shown in FIG. 46, with respect to the same voltage-writing period (i.e., Hsync in the case of the present example), the control signals CNT1 and CNT2 are both at the high level when the writing has just started, so that the all of the first, second, and third output buffers drive the signal line. Next, the control signal CNT1 remains at the high level and the control signal shifts to the low level, so that the first and second buffers drive the signal line. In the latter stage of the voltage-writing period, the control signals CNT1 and CNT2 are both at the low level, so that only the first buffer drives the signal line. Thus, the number of output buffers for driving the signal line is gradually decreased within the same voltage-writing period, thereby gradually increasing the output impedance of the output circuit. Accordingly, as shown in FIG. 46, it becomes possible to sufficiently average the voltage applied to the pixel and to reach the desired voltage value even in the case of a display panel such that the frequency of the pulse signal as determined by the cycle T30 of the reference signal Vref30 cannot ensure that the voltage applied to the pixel is sufficiently average, preventing an appropriate voltage from being applied to the pixel.

As described above, according to the present invention, it is ensured that the duty ratio of a pulse signal for driving a signal line varies in accordance with the signal level of an analog video signal. More-over, the pulse signal is averaged by the low-pass filter characteristics of the signal path from a signal line driving circuit to a pixel, so that an average voltage of the pulse signal is applied to the pixel.

Accordingly, it is possible to apply a desired voltage to the pixel by simply using a binary pulse signal, thereby realizing multiple gray-scale display or full-color display. As a result, it is possible to realize multiple gray-scale signal line driving circuitry, reduce the cost and power consumption, and increase the degree of integration.

By so configurating the signal line driving circuit as to include a digital buffer circuit connected to the signal line and having at least two output voltage levels so as to drive the signal line in accordance with the output signal of the digital buffer circuit, and prescribing one of the output voltage levels to be the GND level, it becomes possible to achieve driving based on a full-color signal line driving system with a single power supply.

By utilizing the transmission characteristics of a signal path from the signal line driving circuit to the pixel as a low-pass filter, there is no need for particularly constructing a low-pass filter. Thus, the configuration of the device can be simplified.

Also according to the present invention, when converting an analog video signal into a pulse signal having a duty ratio corresponding to the analog video signal, the relationship between the analog video signal and the display luminance of the liquid crystal is prescribed to be linear, so that luminance offsets due to the luminance characteristics of the display device can be prevented, whereby a high-quality display device can be realized.

Also according to the present invention, sampled values of an analog video signal are compared with a correction reference signal, and a pulse signal having a duty ratio corresponding to the signal level of the analog video signal and having gray-scale luminance characteristics in which the influence of γ is corrected is generated so as to be output to the signal line as a signal line driving signal. AS a result, even when a video signal, e.g., that of the NTSC type which is intended for television broadcast, is input to the liquid crystal display device, it is possible to obtain optimum high-quality display images on the liquid crystal display device without being influenced by the γ correction, which is performed for television video signals on the transmission side for the sake of display using cathode ray tubes.

Thus, in accordance with an active matrix type display device for analog video signals of the present invention, the cost and power consumption can be reduced and the response speed can be increased, without requiring output stage analog buffers or analog switches. Since various digital video signals or control signals are not required, the peripheral circuitry can be simplified, and the degree of integration increased. Furthermore, it is possible to realize a full-color active matrix type display device having a signal line driving circuit with a single power supply.

Also according to the present invention, it is unnecessary to perform a correction for the luminance characteristics of the display device itself or subject the analog video signal itself to a signal processing, which would otherwise be required for correcting for the γ correction performed for display employing cathode ray tubes. Therefore, any high-speed analog correction circuitry capable of processing the video signal bands, intended for such signal processes, can be omitted, whereby the cost can be reduced, the peripheral circuitry can be simplified, and the degree of integration can be increased.

Also according to the present invention, when converting an analog video signal into a pulse signal having a duty ratio corresponding to the analog video signal so as to be output to the signal line, the duty ratio of the pulse signal is logically alternately-inverted in a periodic manner by using a simple logic operation circuit before the pulse signal is output. As a result, a.c. driving can be realized without incorporating a high-speed analog polarity inversion signal generation circuit capable of processing the band of analog video signals. Thus, the cost and power consumption can be reduced and the degree fo interaction can be increased.

Also according to the present invention, when converting an analog video signal into a pulse signal having a duty ration corresponding to the analog video signal so as to be output to the signal line, the duty ratio of the pulse signal is logically alternately-inverted in a periodic manner by sing a simple logic operation circuit before the pulse signal is output, and the difference in the retention characteristics of the display panel between positive and negative voltages. As a result, optimum image quality can be provided, free from flickering or after-images due to the difference in the voltage retention characteristics between plus and minus voltages.

Also according to the present invention, when converting an analog video signal into a pulse signal having a duty ratio corresponding to the signal level of the analog video signal so as to be output to the signal line, the frequency fo the pulse signal to be output to the signal line, which is a load capacitance, can be varied to a desired value. As a result, the power consumption of the device can be reduced.

Also according to the present invention, when converting an analog video signal into a pulse signal having a duty ratio corresponding to the signal level of the analog video signal so as to be output to the signal line, the output impedance of the signal line driving circuit can be varied to a desired value. As a result, even in the case of a display panel in which the low-pass filter characteristics of a path from the output of the signal line driving circuit to the pixel do not allow the pulse signal to be sufficiently averaged, thereby degrading the display quality, optimum image quality can be provided.

Various other modifications, will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An active matrix type display device comprising:

a display panel including a plurality of pixels arranged in a matrix shape, scanning lines connected to the plurality of pixels, and signal lines connected to the plurality of pixels;

a low-pass filter circuit including one of the plurality of pixels and a corresponding signal line; and a signal line driving circuit for receiving an analog video signal including a sample and hold circuit for sampling the analog video signal and generating a retained signal, a reference signal generation circuit for generating a periodic reference signal, and a comparison circuit for comparing the retained signal with the periodic reference signal, signal and outputting a pulse signal having a duty ratio related to both the signal level of the analog video signal and a low-pass filter characteristic of the low-pass filter circuit;

wherein a periodic horizontal synchronization signal is associated with the analog video signal;

wherein a frequency of the periodic reference signal is greater than the frequency of the periodic horizontal synchronization signal;

wherein the pulse signal has a period related to the period of the reference signal; and wherein the signal line driving circuit outputs the pulse signal to the signal line.

2. An active matrix type display device according to claim 1, wherein the signal line driving circuit includes a digital buffer circuit connected to the signal line and having at least two output voltage levels, and drives the signal line with an output signal of the digital buffer circuit.

3. An active matrix type display device according to claim 1, wherein one of the two output voltage levels is a GND level.

4. An active matrix type display device according to claim 1, wherein the pulse signal is a binary pulse signal.

5. A method for driving an active matrix type display device, the method comprising the steps of:

receiving an analog video signal;

receiving a periodic horizontal synchronization signal associated with the analog video signal;

generating a periodic reference signal having a frequency greater than the frequency of the periodic horizontal synchronization signal;

generating a pulse signal having a period related to the period of the reference signal, and a duty ratio related to a signal level of the analog video signal and a low-pass filter characteristics of a circuit including a pixel and a signal line corresponding to the pixel; and averaging the pulse signal and applying an average voltage to the pixel.

6. An active matrix type display device comprising:

a display panel including a plurality of pixels arranged in a matrix shape, scanning lines connected to the plurality of pixels, and signal lines connected to the plurality of pixels, and a signal line driving circuit which receives an analog video signal, and a periodic horizontal synchronization signal associated with the analog video signal;

wherein the signal line driving circuit generates a periodic reference signal having a frequency greater than the frequency of the periodic horizontal synchronization signal, and a pulse signal having a duty ratio related to both the signal level of the analog video signal and an operational characteristic associated with a characteristic of the pixel and the corresponding signal line.

and wherein the signal line driving circuit drives at least one of the signal lines.

7. An active matrix type display device according to claim 6, wherein the operational characteristic associated with a characteristic of the pixel and the corresponding signal line is a duty cycle.

8. An active matrix type display device according to claim 6, wherein the operational characteristic associated with a characteristic of the pixel and the corresponding signal line is a pulse duty cycle.

9. An active matrix type display device according to claim 6, wherein the operational characteristic associated with a characteristic of the pixel and the corresponding signal line is a digital duty cycle.

10. An active matrix type display device according to claim 6, wherein a period of the pulse signal is less than a period of a video horizontal synchronizing signal.

11. An active matrix type display device according to claim 6, wherein the characteristic of the pixel and the corresponding signal line is related to a low-pass filter characteristic of the pixel and the corresponding signal line.

* * * * *